US007543367B2

(12) United States Patent
Beers et al.

(10) Patent No.: US 7,543,367 B2
(45) Date of Patent: Jun. 9, 2009

(54) METHOD OF ASSEMBLING A TEMPERATURE CONTROLLED RAILWAY CAR

(75) Inventors: Albert A. Beers, Duncanville, TX (US); G. Wayne Kirk, Jr., Piedmont, OK (US); Stephen W. Smith, Dallas, TX (US); John L. Wright, Edmond, OK (US); Wade L. McCallon, Cartersville, GA (US)

(73) Assignee: Trinity Industries, Inc., Dallas, TX (US)

( * ) Notice: Subject to any disclaimer, the term of this patent is extended or adjusted under 35 U.S.C. 154(b) by 602 days.

(21) Appl. No.: 11/037,803

(22) Filed: Jan. 18, 2005

(65) Prior Publication Data

US 2005/0204536 A1 Sep. 22, 2005

Related U.S. Application Data

(63) Continuation-in-part of application No. 10/071,513, filed on Feb. 8, 2002, now Pat. No. 6,892,433.

(60) Provisional application No. 60/576,543, filed on Jun. 3, 2004, provisional application No. 60/267,882, filed on Feb. 9, 2001.

(51) Int. Cl.
*B61D 17/00* (2006.01)

(52) U.S. Cl. ..... 29/469; 105/404

(58) Field of Classification Search ..... 29/469, 29/428, 460, 436, 455.1, 525.14; 52/742.1, 52/749.15, 404.1; 105/404, 355, 409, 413, 105/423; 296/39.3

See application file for complete search history.

(56) References Cited

U.S. PATENT DOCUMENTS

| | | | | |
|---|---|---|---|---|
| 3,003,810 | A | 10/1961 | Kloote et al. | 296/31 |
| 3,142,265 | A | 7/1964 | Ford | 105/423 |
| 3,187,853 | A | 6/1965 | Glaser et al. | 189/34 |
| 3,206,946 | A | 9/1965 | Lindersmith et al. | 62/407 |
| RE26,131 | E | 12/1966 | Johansson et al. | 105/409 |
| 3,301,147 | A | 1/1967 | Clayton et al. | |
| 3,323,471 | A | 6/1967 | Dean et al. | 105/401 |
| 3,481,642 | A | 12/1969 | Bonallack et al. | 296/31 |
| 3,711,148 | A | 1/1973 | Hindin | 296/28 |
| 3,746,388 | A | 7/1973 | Robinson | 296/28 |
| 3,777,430 | A | 12/1973 | Tischuk | 52/309 |
| 4,122,641 | A | 10/1978 | Bard et al. | 52/403 |
| 4,404,057 | A | 9/1983 | Morrison et al. | 156/324 |
| 4,612,744 | A | 9/1986 | Shamash | 52/220 |

(Continued)

OTHER PUBLICATIONS

Union Pacific Railroad, Trinity Rail Group, Mechanical Engineering Design Review, 2 pages, Mar. 25, 2003.

(Continued)

*Primary Examiner*—John C Hong
(74) *Attorney, Agent, or Firm*—Baker Botts L.L.P.

(57) ABSTRACT

A manufacturing facility and method for assembling a railway car having a composite box structure mounted on a railway car underframe are provided. The composite box structure may be defined in part by exterior metal sheets, side stakes attached to the exterior metal sheets, insulating materials disposed between the side stakes and the exterior metal sheets and at least one layer of fiber reinforced material. The composite box structure preferably includes a pair of endwalls, a pair of sidewalls, a floor assembly and a roof assembly.

18 Claims, 18 Drawing Sheets

U.S. PATENT DOCUMENTS

| | | | | |
|---|---|---|---|---|
| 5,088,434 | A | 2/1992 | Harding | 114/85 |
| 5,109,777 | A | 5/1992 | Ohmura et al. | 105/401 |
| 5,113,769 | A | 5/1992 | Okuno et al. | 105/422 |
| 5,274,979 | A | 1/1994 | Tsai | 52/595 |
| 5,277,011 | A | 1/1994 | Serrano Martin | 52/588 |
| 5,333,554 | A | 8/1994 | Yamada et al. | 105/397 |
| 5,403,063 | A | 4/1995 | Sjostedt et al. | 296/187 |
| 5,460,290 | A | 10/1995 | Hanning et al. | 220/421 |
| 5,677,029 | A | 10/1997 | Prevorsek et al. | 428/113 |
| 5,685,229 | A | 11/1997 | Ohara et al. | 105/397 |
| 5,716,487 | A | 2/1998 | Sumerak | 156/359 |
| 5,730,485 | A | 3/1998 | Sjostedt et al. | 296/182 |
| 5,765,485 | A | 6/1998 | Thoman et al. | 105/404 |
| 5,802,984 | A | 9/1998 | Thoman et al. | 105/404 |
| 5,811,035 | A | 9/1998 | Mockry | 261/111 |
| 5,851,446 | A | 12/1998 | Bardo et al. | 261/111 |
| 5,855,174 | A * | 1/1999 | Thoman et al. | 105/413 |
| 5,857,414 | A | 1/1999 | Thoman et al. | 105/397 |
| 5,868,080 | A | 2/1999 | Wyler et al. | 108/57.25 |
| 5,890,435 | A | 4/1999 | Thoman et al. | 105/404 |
| 5,988,074 | A | 11/1999 | Thoman | 105/404 |
| 6,000,342 | A | 12/1999 | Thoman et al. | 105/413 |
| 6,138,580 | A | 10/2000 | Thoman | 105/396 |
| 6,199,488 | B1 | 3/2001 | Favaron et al. | 108/57.25 |
| 6,227,125 | B1 | 5/2001 | Schroeder et al. | 105/401 |
| 6,233,892 | B1 | 5/2001 | Tylman | 52/309.12 |
| 6,251,185 | B1 | 6/2001 | Morrison et al. | 118/681 |
| 6,257,800 | B1 | 7/2001 | Masters | 405/224 |
| 6,290,279 | B1 | 9/2001 | Haight et al. | 296/97.23 |
| 6,395,210 | B1 | 5/2002 | Head et al. | 264/137 |
| 6,508,076 | B1 | 1/2003 | Gast et al. | 62/408 |
| 6,722,287 | B2 | 4/2004 | Norton et al. | 105/404 |
| 2006/0065152 | A1 | 3/2006 | Heitmeyer et al. | 105/404 |

OTHER PUBLICATIONS

Roof Appl Drawing, R-004-7008, 2 pgs, Mar. 19, 2003.
Side Construction Assy Right Side, S-003-7056, 1 pg, Mar. 28, 2003.
End Arrangement A-End, M-012-7065, 1 pg, Jan. 21, 2003.
End Arrangement B-End, M-012-7064, 1 pg, Jan. 14, 2003.
Section Thru Car 64 Ft Refrigerated Steel Box Car, M-022-7027, 5 pgs, Feb. 10, 2003.
Trinity Vision News Letter—Railcar News from Trinity Industries, Fall 2000 pp. 1-8, 2000.

* cited by examiner

METHOD OF ASSEMBLING A TEMPERATURE CONTROLLED RAILWAY CAR

RELATED APPLICATION

This application claims the benefit of Provisional Patent Application Ser. No. 60/576,543 entitled "Manufacturing Facility and Method of Assembling a Temperature Controlled Railway Car" filed Jun. 3, 2004.

This application is a Continuation-In-Part Application of U.S. application Ser. No. 10/071,513 entitled "Manufacturing Facility and Method of Assembling Temperature Controlled Railway Car" filed Feb. 8, 2002, now U.S. Pat. No. 6,892,433 which claims the benefit of U.S. Provisional Application Ser. No. 60/267,882 entitled "Temperature Controlled Railway Car" filed Feb. 9, 2001.

This application is related to U.S. patent application Ser. No. 10/071,165 entitled "Pultruded Panel" filed Feb. 8, 2002, now abandoned; U.S. Pat. No. 6,722,287 entitled "Roof Assembly and Airflow Management System for a Temperature Controlled Railway Car" and U.S. Pat. No. 6,575,102 entitled "Temperature Controlled Railway Car" filed Feb. 8, 2002 which all claim priority from the same U.S. Provisional Application Ser. No. 60/267,882, filed Feb. 9, 2001.

TECHNICAL FIELD

The present invention is related to railway cars, manufacturing facilities and method of assembling railway cars and more particularly forming components of a composite box structure and attaching the components to a railway car underframe.

BACKGROUND OF THE INVENTION

Over the years, general purpose railway boxcars have progressed from relatively simple wooden structures mounted on flat cars to more elaborate arrangements including insulated walls and refrigeration equipment. Various types of insulated boxcars are presently manufactured and used. A typical insulated boxcar includes an enclosed structure mounted on a railway car underframe. The enclosed structure generally includes a floor assembly, a pair of sidewalls, a pair of endwalls and a roof. The sidewalls, endwalls and roof often have an outer shell, one or more layers of insulation and interior paneling.

The outer shell of many railway boxcars often has an exterior surface formed from various types of metal such as steel or aluminum. The interior paneling is often formed from wood and/or metal as desired for the specific application. For some applications the interior paneling has been formed from fiber reinforced plastic (FRP). Various types of sliding doors including plug type doors are generally provided on each side of conventional boxcars for loading and unloading freight. Conventional boxcars may be assembled from various pieces of wood, steel and/or sheets of composite materials such as fiberglass reinforced plastic. Significant amounts of raw material, labor and time are often required to complete the manufacture and assembly of conventional boxcars.

The underframe for many boxcars include a center sill with a pair of end sill assemblies and a pair of side sill assemblies arranged in a generally rectangular configuration corresponding approximately with dimensions for the floor of the boxcar. Cross bearers are provided to establish desired rigidity and strength for transmission of vertical loads to the associated side sills which in turn transmit the vertical loads to the associated body bolsters and for distributing horizontal end loads on the center sill to other portions of the underframe. Cross bearers and cross ties cooperate with each other to support a plurality of longitudinal stringers. The longitudinal stringers are often provided on each side of the center sill to support the floor of a boxcar. Examples of such railway car underframes are shown in U.S. Pat. Nos. 2,783,718 and 3,266,441.

Some railway cars or boxcars may be manufactured using sidewall assemblies with all or portions of a respective side sill assembly formed as an integral component thereof. In a similar manner, such railway cars and/or boxcars may also be manufactured with endwall assemblies having all or portions of a respective end sill formed as an integral component thereof.

Traditionally, refrigerated boxcars often have less inside height than desired for many types of lading and a relatively short interior length. Heat transfer rates for conventional insulated boxcars and refrigerated boxcars are often much greater than desired. Therefore, refrigeration systems associated with such boxcars must be relatively large to maintain desired temperatures while shipping perishable lading.

A wide variety of composite materials have been used to form railway cars and particular boxcars. U.S. Pat. No. 6,092,472 entitled "Composite Box Structure For A Railway Car" and U.S. Pat. No. 6,138,580 entitled "Temperature Controlled Composite Boxcar" show some examples. One example of a composite roof for a railway car is shown in U.S. Pat. No. 5,988,074 entitled "Composite Roof for a Railway Car".

Ballistic resistant fabrics such as Bulitex® scuff and wall liners have previously been used to form liners for highway truck trailers.

SUMMARY OF THE INVENTION

In accordance with teachings of the present invention, several disadvantages and problems associated with manufacture and assembly of insulated boxcars, refrigerated boxcars and other types of temperature controlled railway cars have been substantially reduced or eliminated. One embodiment of the present invention includes a composite box structure with a temperature control system and an airflow management system satisfactory for use with a refrigerated boxcar or a temperature controlled railway car and methods for manufacture and assembly of such railway cars. Another embodiment of the present invention includes a roof assembly which may be satisfactory for use with insulated boxcars, refrigerated boxcars and other types of temperature controlled railway cars.

A composite box structure incorporating teachings of the present invention combines benefits of conventional railway car components with benefits of plastic and composite insulating materials. A composite box structure incorporating teachings of the present invention may provide enhanced insulation, increased load carrying capacity, better temperature regulation, increased service life and reduced maintenance costs as compared to a typical refrigerated boxcar. The present invention allows designing a roof assembly with insulating materials having optimum thickness to substantially minimize heat transfer rates between the interior and the exterior of an associated railway car and optimizing interior load carrying capacity. Structural integrity may be maintained using conventional materials such as steel or aluminum alloys to form exterior portions of the roof assembly.

A railway car may be formed in accordance with teachings of the present invention with similar or reduced costs as compared to conventional refrigerated boxcars and insulated boxcars with substantially improved load carrying capacity and thermal energy characteristics. Structural members of the resulting railway car may be formed from steel alloys, aluminum alloys or other materials which may more easily be repaired as compared with some composite materials. Composite materials with improved heat transfer characteristics may be used as either structural or nonstructural members while at the same time increasing load carrying capability.

Further aspects of the present invention include forming sidewalls and endwalls for a composite box structure defined in part by a plurality of side stakes or support posts with metal side sheets attached to one side of the side stakes and at least one layer of fiber reinforced material attached to the opposite side of the side stakes with void spaces formed therebetween. Associated endwalls may be formed with a plurality of end beams with metal end sheets or side sheets attached to one side of the end beams and at least one layer of fiber reinforced material attached to the opposite side of the end beam with void spaces formed therebetween. The endwall assemblies and the sidewall assemblies may be placed in a foam press tilted at an angle of approximately ten (10) degrees. Urethane foam or other insulating materials having desired thermal insulation characteristics may be injected into the void spaces.

For some applications roof, sidewall, floor and endwall and/or railway car underframes may be fabricated at the same facility. For other applications one or more components may be remotely fabricated and shipped to another facility to complete fabrication of railway cars in accordance with teachings of the present invention. A composite box structure and associated insulated boxcar or temperature controlled railway car formed in accordance with teachings of the present invention may accommodate various geometric configurations and load carrying requirements to meet customer needs concerning size and temperature specifications for different types of lading carried in each railway car.

Manufacturing procedures associated with plastic materials and insulating materials may be modified in accordance with teachings of the present invention to form various portions of a composite box structure. For example sidewall and endwall assemblies may be formed with relatively thick insulating materials disposed between exterior side sheets and a layer of fiber reinforced material by injecting liquid insulating foam therebetween. Support posts and/or end beams may also be disposed between and attached to adjacent portions of the side sheets and associated layer of fiber reinforced material prior to injecting liquid insulating foam. Composite box structures incorporating with teachings of the present invention may have improved heat transfer characteristics as compared with conventional insulated boxcars and refrigerated boxcars.

BRIEF DESCRIPTION OF THE DRAWINGS

For a more complete understanding of the present invention, and the advantages thereof, reference is now made to the following written description taken in conjunction with the accompanying drawings, in which.

DETAILED DESCRIPTION OF THE INVENTION

Preferred embodiments of the invention and its advantages are best understood by reference to FIGS. 1A-23 of the drawings, like numerals are used for like and corresponding parts of the various drawings.

Various aspects of the present invention will be described with respect to temperature control railway car 20. However, the present invention is not limited to temperature controlled railway cars. For example, various features of the present invention may be satisfactory used to form insulated boxcars and any other type of freight car or railway car having sidewall assemblies, endwall assemblies, floor assemblies and/or roof assemblies.

Figure 1A:
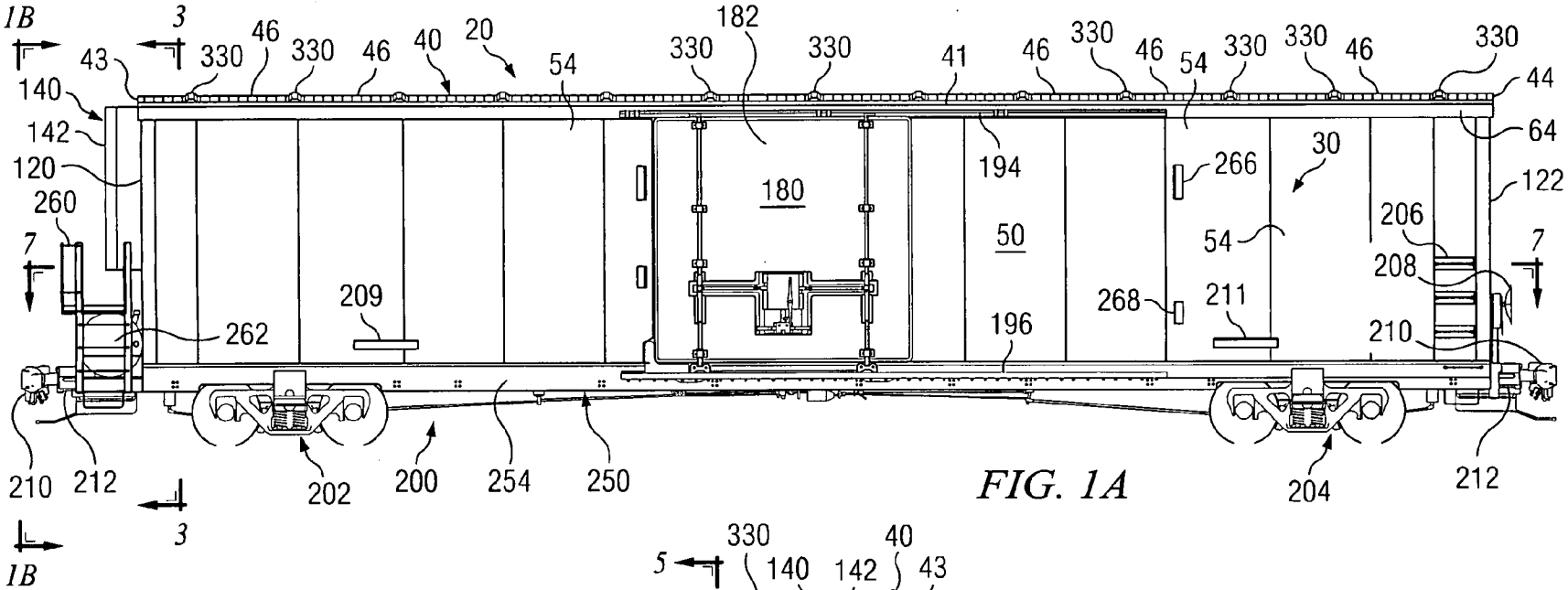
FIG. 1A is a schematic drawing in elevation showing a side view of a temperature controlled railway car incorporating teachings of the present invention.
Figure 1B:
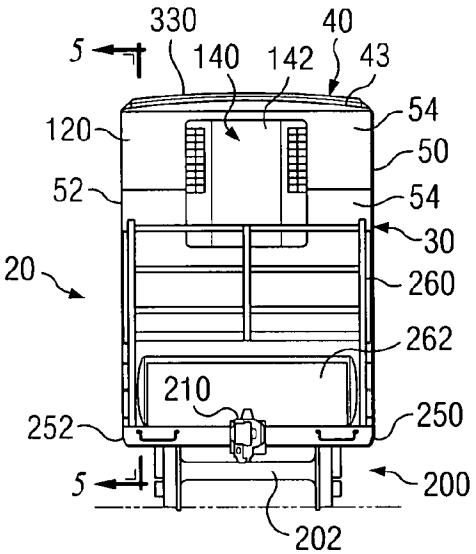
FIG. 1B is an end view of the temperature controlled railway car taken along lines 1B-1B of FIG. 1A.

Temperature controlled railway car 20 incorporating teachings of the present invention is shown in FIGS. 1A and 1B with composite box structure 30 mounted on railway car underframe 200. As discussed later in more detail, temperature controlled railway car 20 may include temperature control system 140 and airflow management system 300.

For embodiments of the present invention as shown in FIGS. 1A-23, temperature controlled railway car 20 may have exterior dimensions which satisfy requirements of Plate F and associated structural design requirements of the Association of American Railroads (AAR). However, teachings of the present invention may be used to design and manufacture railway cars which satisfy other AAR requirements. The present invention is not limited to railway cars that satisfy Plate F requirements.

Forming various components of composite box structure 30 in accordance with teachings of the present inventions and assembling these components on railway car underframe 200 may result in reducing the weight of temperature controlled railway car 20 while at the same time increasing internal volume and/or load carrying capacity as compared to more conventional refrigerated boxcars satisfying the same AAR clearance plate requirements.

The term "composite box structure" refers to a generally elongated structure having a roof assembly, a floor assembly, a pair of sidewall assemblies, and a pair of endwall assemblies which cooperate with each other to provide a generally hollow interior satisfactory for carrying various types of lading associated with insulated boxcars and refrigerated boxcars. Portions of the roof assembly, floor assembly, sidewall assemblies and/or endwall assemblies may be formed from conventional materials such as steel alloys and other metal alloys used to manufacture railway cars. Portions of the roof assembly, floor assembly, sidewall assemblies and/or endwall assemblies may also be formed from composite materials such as thermal plastics, insulating materials, fiber reinforced plastics, fiber reinforced pultrusions and fiber reinforced materials such as ballistic resistant fabrics. Examples of some of the materials used to form a composite box structure incorporating teachings of the present invention will be discussed throughout this application.

The term "support post" may be used to refer to side posts, side stakes or other structural components satisfactory for use in forming a sidewall assembly incorporating teachings of the present invention. The term "end beam" may be used to refer to structural components satisfactory for use in forming an endwall assembly incorporating teachings of the present invention. For some applications support posts and end beams may be formed from metal I beams having similar cross sections. However, support post and end beams may have a wide variety of other cross sections and may be formed from a wide variety of materials.

The term "FRP" may be used to refer to both fiber reinforced plastic and glass fiber reinforced plastic. A wide variety of fibers in addition to glass fibers may be satisfactorily used to form portions of a composite box structure incorporating teachings of the present invention.

The term "insulating materials" may include urethane foam, closed cell urethane foam, polyvinylfloride materials, polycarbonate materials, urethane foam blocks and any other material having satisfactory heat transfer characteristics for use in manufacturing a railway car incorporating teachings of the present invention. Some insulating materials may also provide structural strength. Other insulating materials may provide very little (if any) structural strength.

Composite box structure 30 may be formed from several major components including roof assembly 40, sidewall assemblies 50 and 52, floor assembly 80 and endwall assemblies 120 and 122. Major components associated with composite box structure 30 may be fabricated individually in accordance with teachings of the present invention and then attached to or assembled on railway car underframe 200 to form temperature controlled railway car 20. Individually manufacturing or fabricating major components of composite box structure 30 may allow optimum use of conventional railcar manufacturing techniques. For example, side posts and door posts may be welded with top chords and bottom chords or side sill assemblies using conventional railcar manufacturing techniques to provide structural members for a sidewall assembly.

For embodiments of the present invention such as shown in FIGS. 1A, 1B, 2, 3, 4A, 4B, 4C and 5 portions of railway car underframe 200 may be manufactured and assembled using conventional railcar manufacturing procedures and techniques. Railway car underframe 200 may be mounted on a pair of railway car trucks 202 and 204 located proximate respective ends of railway car underframe 200. For some applications ladder 206 may be disposed within exterior portions of sidewall assemblies 50 and 52. See FIG. 1A. For other applications, one or more ladders may be formed as part of railway car underframe 200 (not expressly shown). Hand brake 208 and accessories may be included as part of railway car underframe 200. Standard railcar couplings 210 may also be provided at each end of railway car underframe 200. Each coupling 210 may include respective end of car cushioning unit 212 disposed at each end of center sill 214.

Figure 2:
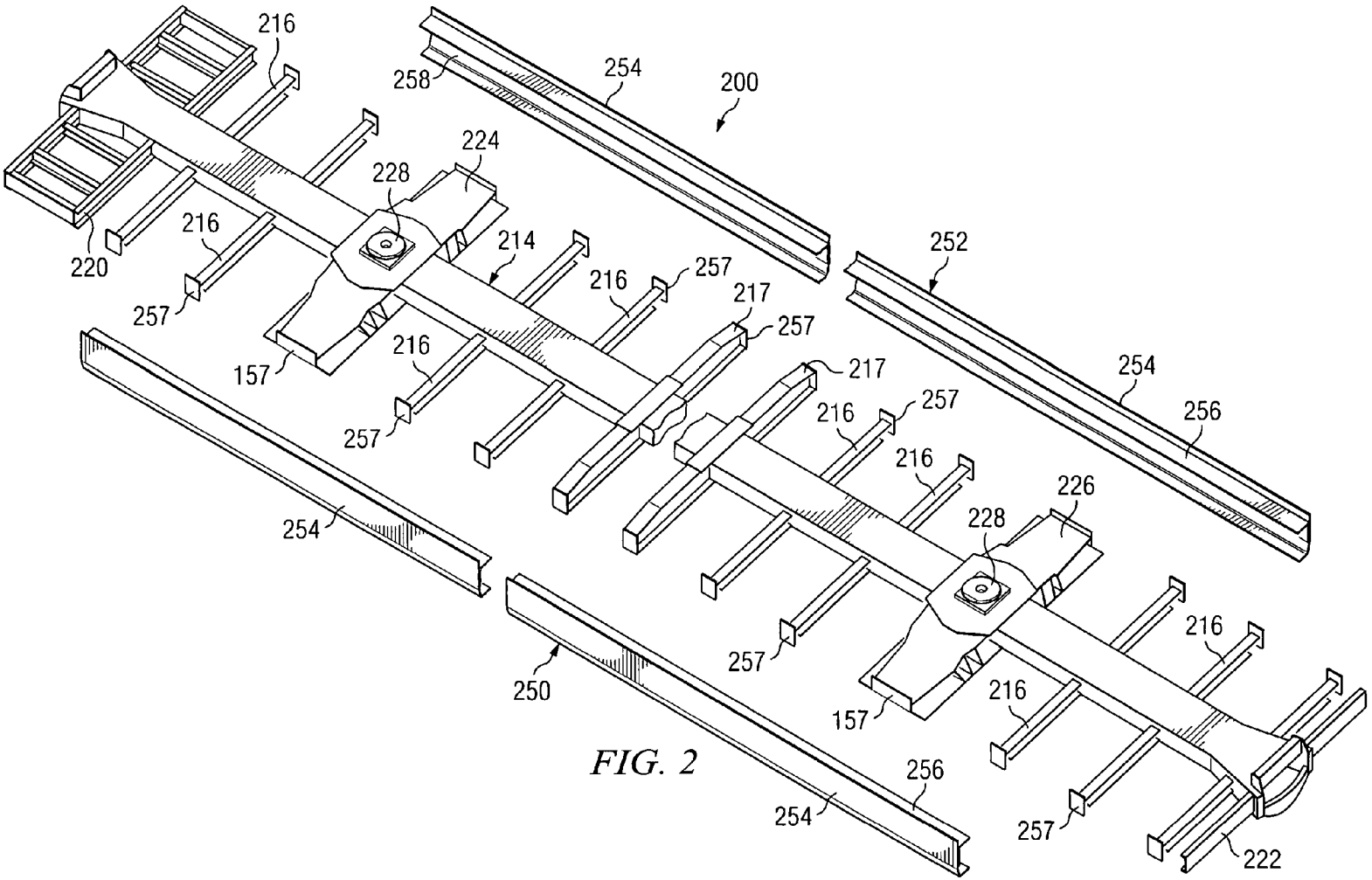
FIG. 2 is a schematic drawing showing an isometric view with portions broken away of a railway car underframe satisfactory for use with a composite box structure incorporating teachings of the present invention.

As shown in FIG. 2 railway car underframe 200 may include center sill 214, cross ties 216, cross bearers 217 and body bolsters 224 and 226 arranged in a generally rectangular configuration. Body bolsters 224 and 226 may be disposed on respective railway trucks 202 and 204. Body bolsters 224 and 226 extend laterally from center sill 214. Each body bolster 224 and 226 may include respective center plates 228. Cross ties 216, cross bearers 217 and body bolsters 224 and 226 may sometimes be referred to as "cross members." Side sill assemblies 250 and 252 are shown detached from respective ends 257 of crossties 216 and cross bearers 217 and respective ends 157 of body bolsters 224 and 226.

Cross ties 216 and cross bearers 217 may be attached to and extend laterally from center sill 214. For some applications railway car underframe 200 may be initially manufactured with side sill assemblies 250 and 252 attached with respective cross ties 216, cross bearers 217 and body bolsters 224 and 226. During manufacture of sidewall assemblies 50 and 52, side sill assemblies 250 and 252 may be removed from railway car underframe 200 and integrated into respective sidewall assemblies 50 and 52. See for example FIG. 22 Step 573.

Respective plates 257 may be disposed on the extreme ends of each cross tie 216 and cross bearer 217. Plates 257 may include openings or holes (not expressly shown) to accommodate bolts or other mechanical fasteners. Plates 257 facilitate removal of side sills 250 and 252 and reattachment of side sills 250 and 252 as integral components of respective sidewall assemblies 50 and 52. Plates 157 with openings or holes (not expressly shown) similar to plates 257 may also be attached with the ends of body bolsters 224 and 226 for use in engaging and disengaging side sill assemblies 250 and 252.

Portions of floor assembly 80 may be disposed on center sill 214, cross ties 216, cross bearers 217 and body bolsters 224 and 226. Portions of floor assembly 80 may also be disposed on portions of end sill assemblies 220 and 222 and portions of side sill assemblies 250 and 252. See FIGS. 3, 4A, 4B, 4C and 5. The number of cross ties 216 and cross bearers 217 may be varied depending upon the desired load carrying characteristics for the resulting railway car 20. Portions of floor assembly 80 may be adhesively bonded with portions of railway car underframe 200.

Side sill assemblies 250 and 252 may have substantially the same configuration and dimensions. As shown in FIGS. 2, 3, 4A and 4B, side sill assemblies 250 and 252 have generally J shaped cross sections. The configuration of exterior surface 254 of side sill assemblies 250 and 252 may correspond with dimensions of AAR Plate F or other applicable AAR requirements. Respective support members 256 may be attached to interior surface 258 of side sill assemblies 250 and 252. Support members 256 may extend along substantially the full length of respective side sill assembly 250 and 252. Support members 256 may be formed from metal angles having desired dimensions compatible with railway car underframe 200 and floor assembly 80. Spacers (not expressly shown) may also be disposed at selected locations on interior surface 258 of each side sill assemblies 250 and 252. The dimensions associated with such spacers may be selected to be compatible with attachment plates 157 and 257.

For one embodiment sidewall assembly 50 may be mounted on one longitudinal side of railway car underframe 200 with side sill assembly or bottom chord 250 disposed adjacent to respective attachment plates 157 and 257. In a similar manner sidewall assembly 52 may be mounted on an opposite longitudinal side of railway car underframe 200 with side sill assembly or bottom chord 252 disposed adjacent to respective attachment plates 157 and 257. Various types of mechanical fasteners 255 and/or welds may be formed between side sill assemblies 250 and 252 and respective attachment plates 157 and 257. For some applications Huck® type mechanical fasteners may be used to attach side sill assemblies 250 and 252 with the respective attachment plates 157 and 257 of railway car underframe 200. Side sill assemblies 250 and 252 may be fabricated as integral components of sidewall assemblies 50 and 52.

As shown in FIGS. 1A and 1B refrigeration unit 142 may be mounted on endwall assembly 120 of composite box structure 30. Refrigeration unit 142 may be mounted on the exterior of endwall assembly 120 and partially disposed within opening 127 of endwall assembly 120. See FIG. 3. End platform 260 may be mounted on railway car underframe 200 near refrigeration unit 142 to provide easy access to refrigeration unit 142. External fuel tank 262 may be located on end platform 260 proximate refrigeration unit 142. End platform 260 provides convenient access to both fuel tank 262 and refrigeration unit 142.

Temperature control system 140 preferably includes refrigeration unit or cooling unit 142 and airflow management system 300. For some applications such as transporting products in sub-zero, winter environments temperature control system 140 may include a heater (not expressly shown). Refrigeration unit 142 may be a self-contained refrigeration unit including a compressor (not expressly shown), a condenser (not expressly shown), airflow blowers (not expressly shown), external fuel tank 260 and a diesel engine (not expressly shown). For some applications, refrigeration unit 142 may provide airflow in the range of 3200 CFM. Self-contained refrigeration unit 142 provides advantages of easier and faster maintenance as compared to conventional refrigerated boxcars with similar performance characteristics. As a result, temperature control system 140 generally lowers maintenance time and costs and increases the amount of time that temperature controlled railway car 20 remains in service between repairs.

Refrigeration unit 142 may be a programmable unit able to control and maintain desired temperatures within composite box structure 30. Refrigeration unit 142 may include a keypad for inputting data for desired system performance and a microprocessor to control and monitor the functions and performance of refrigeration unit 142 and temperature control system 140. Refrigeration unit 142 may also include a satellite monitoring and control system (not expressly shown) and/or cellular technology to transmit to remote locations information such as the performance and location of refrigeration unit 142 or the temperature inside composite box structure 30. Various types of refrigeration systems are commercially available from companies such as Thermo King, Carrier and Dring. Such units may be frequently used in motor carrier trailers and other large containers.

Airflow management system 300 may provide relatively uniform distribution of air at a desired temperature throughout the interior length, width and height of composite box structure 30. Airflow management system 300 allows cooled air to circulate from refrigeration unit 142, around and through products or lading contained within composite box structure 30, and back to refrigeration unit 142 or out of composite box structure 30. Airflow management system 300 may also be capable of circulating fresh air from outside composite box structure 30 or heated air throughout interior portions of composite box structure 30.

Airflow management system 300 may include various features which keep products shipped within composite box structure 30 spaced from interior surfaces of the sidewall assemblies 50 and 52, endwall assemblies 120 and 122, and floor assembly 80 to create openings or gaps for airflow around the product. These features include, but are not limited to, plenum system 310, secondary floor 110, interior bulkheads or end barriers 280 and 380, corrugations 63 formed in layers 61, and scuff plates 241 and 242.

Endwall assemblies 120 and 122 and sidewall assemblies 50 and 52 may be formed using similar materials and techniques. For one application side sheets 54 may be formed from twelve (12) gauge steel. Support posts 56 and end beams 126 may be three (3) inch I-beams. Foam insulation 58 may have a thickness of approximately four (4) inches. Layers 61 and 128 may be formed from Bulitex® material having a thickness of approximately 0.06 to 0.08 inches.

For sidewall assemblies 50 and 52, support posts 56 extend generally vertically between respective side sill assemblies 250 and 252 and associated top chord 64. Endwall assemblies 120 and 122 may be formed with end beams 126 having an I-beam configuration similar to support posts 56. However, end beams 126 disposed within endwall assemblies 120 and 122 may extend generally horizontally with respect to each other, respective bottom plate 124 and railway car underframe 200. See FIGS. 4A, 4B and 4C. Endwall assemblies 120 and 122 may be fabricated with respective bottom plates 124 formed as integral components for mounting on end sills 220 and 222.

End beams 126 may be attached with respective metal sheets 54. Metal sheets 54 of endwall assemblies 120 and 122 may also be referred to as "end sheets" or "side sheets." Respective isolators 60 may be attached to interior surface or first surface 125 of each support beam 126 associated with endwall assembly 122. Layer 128 may also be attached with associated isolators 60 opposite from end sheets 54. Foam insulation 58 may be disposed between and bonded with adjacent portions of end beams 126, interior surface 55 of metal sheets 54 and adjacent portions of layer 128.

For some applications isolators 60 associated with endwall assemblies 120 and 122 may be formed from DIVINYCELL® cellular polyvinyl chloride plastic blocks. DIVINYCELL® blocks are available from Diab AB Corporation located in Sweden. DIVINYCELL® strips may also be placed on end closures or end plates (not expressly shown) attached to opposite ends of end beams 126.

Layers 128 of endwall assemblies 120 and 122 may be formed from the same fiber reinforced material used to form layers 61 of sidewall assemblies 50 and 52 and layers 45 of roof assembly 40. However, other types of material may be satisfactorily used to form layers 128 because interior bulkheads 280 and 380 prevent direct contact between lading carried within composite box structure 30 and layers 128 of endwall assemblies 120 and 122.

Interior bulkhead or end barrier 280 may be formed within composite box structure 30 and attached to endwall assembly 120 to form airflow paths therebetween. See FIGS. 3, 4A and 4C. Interior bulkhead 280 may be formed by attaching a plurality of support beams 284 and 284*a* and a plurality of pultruded panels 282 with each other. Support beams 284 and 284*a* are shown by dotted lines in FIG. 3. Various types of supporting structures other than support beams 284 and 284*a* may be used to attach pultruded panels 282 with adjacent portions of an endwall assembly 120.

For one application, support beams 284 and 284*a* may be securely attached with adjacent portions end beams 126 of endwall assembly 120 by fasteners 290. Support beams 284*a* may have a reduced length to accommodate opening 127 which provides access to refrigeration unit 142. Support beams 284 and 284*a* preferably include respective web 285 with respective first flange 286 and respective second flange 287 attached thereto. One or more openings 288 may be formed in each web 285 to accommodate airflow therethrough. For some applications layer 128 of endwall assembly 120 and end barrier 280 cooperate with each other to provide a return airflow path from the interior of composite box structure 30 to temperature control system 140.

For some applications, each second flange 287 associated with support beams 284 and 284*a* may have a substantially reduced width as compared with the width of each first flange 286. The reduced width of second flanges 287 accommodates use of mechanical fasteners such as blind screws or Huck® fasteners 290 to engage support beams 284 and 284*a* with end beams 126.

Panels 282 may be attached to or mounted on support beams 284 and 284*a* using various techniques such as adhesive bonding and/or mechanical fasteners. Panels 282 may be formed from various types of fiber reinforced materials. For some applications panels 282 may be formed from the same Bulitex® materials used to form layers 45, 61 and 128. Channels or open beams 294 may be bonded with respective panels 282. Channels or open beams 294 may cooperate with each other to form a grid type structure on support beams 284 and 284*a* to transfer loads from cargo carried within associated composite box structure 30 to attached end beams 126. A plurality of holes or openings 296 may also be formed in each panel 282. See FIG. 4C.

The location of holes 296 may be selected to correspond with associated support beams 284 and 284*a*. Openings 296 allow fasteners 292 to be inserted through respective holes 296 and securely engaged with flanges 287. A plurality of plastic inserts 298 may be disposed within each opening 296 and any associated channel to cover respective mechanical fastener 292. Plastic inserts 298 cooperate with each other to provide a smooth exterior surface on associated panels 282. Various types of blind bolts, screws and other mechanical fasteners may be satisfactorily used to attach panels 282 with a supporting structure formed in accordance with teachings of the present invention.

Figure 3:
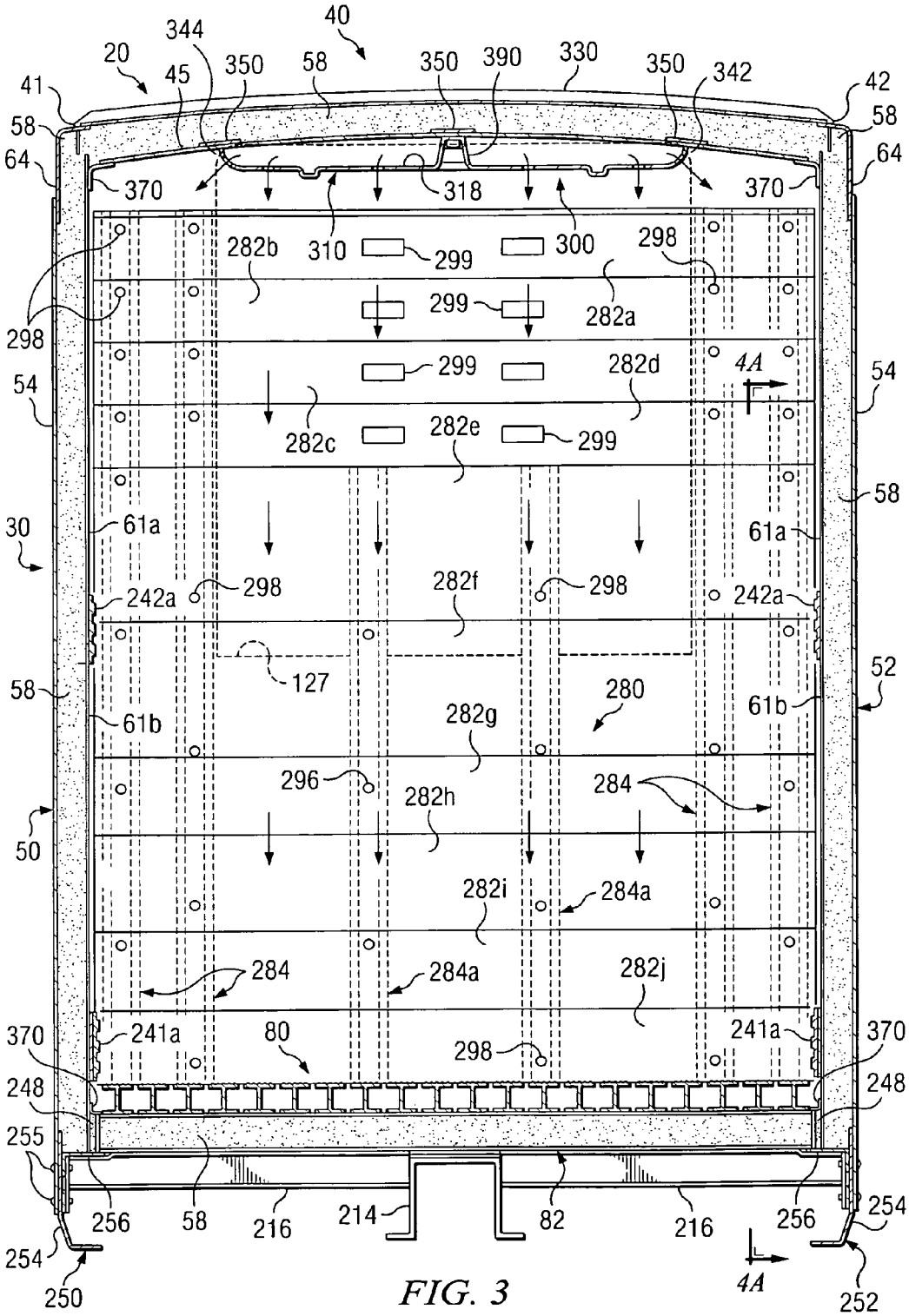
FIG. 3 is a schematic drawing in section with portions broken away taken along lines 3-3 of FIG. 1A showing interior portions of a temperature controlled railway car incorporating teachings of the present invention.
Figure 4A:
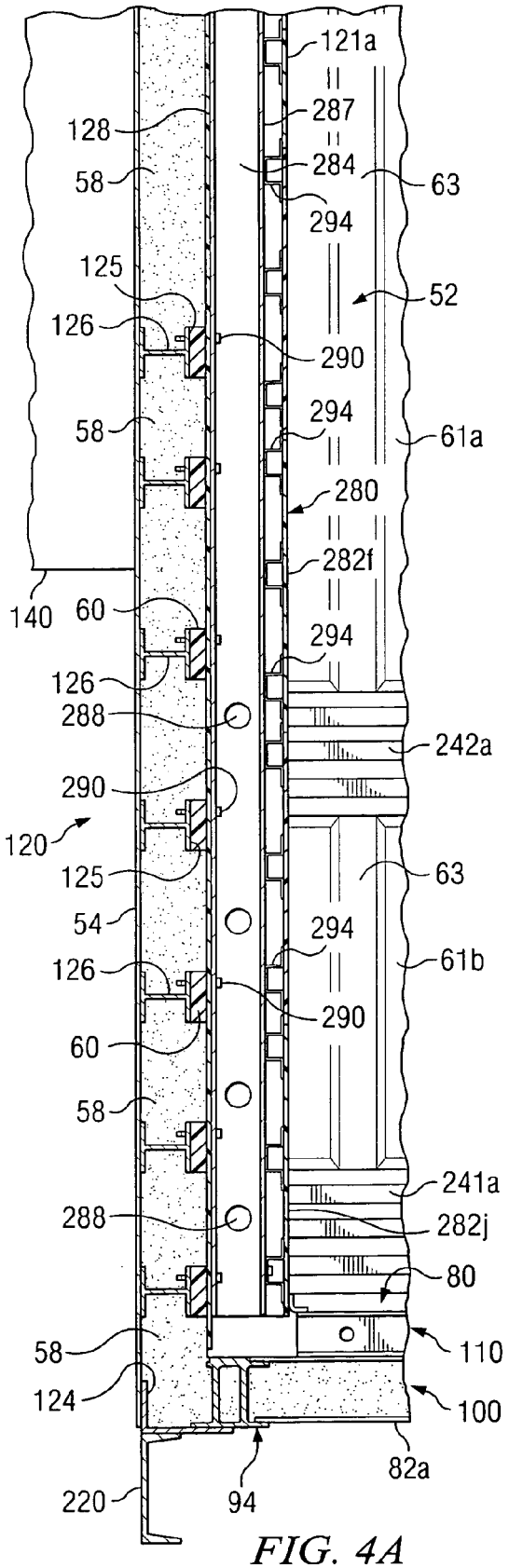
FIG. 4A is a schematic drawing in section and in elevation with portions broken away showing interior of portions of a temperature controlled railway car incorporating teachings of the present invention adjacent to a first endwall assembly taken along lines 4A-4A of FIG. 3.
Figure 4B:
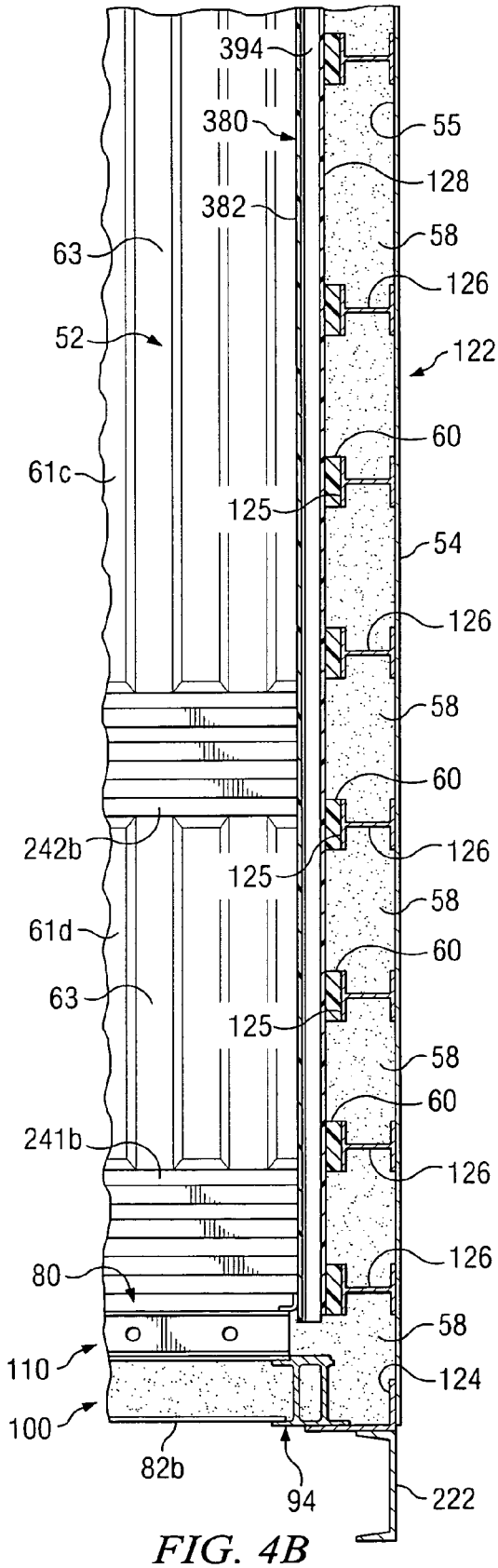
FIG. 4B is a schematic drawing in section and in elevation with portions broken away showing interior of portions of a temperature controlled railway car incorporating teachings of the present invention adjacent to a second endwall assembly.
Figure 4C:
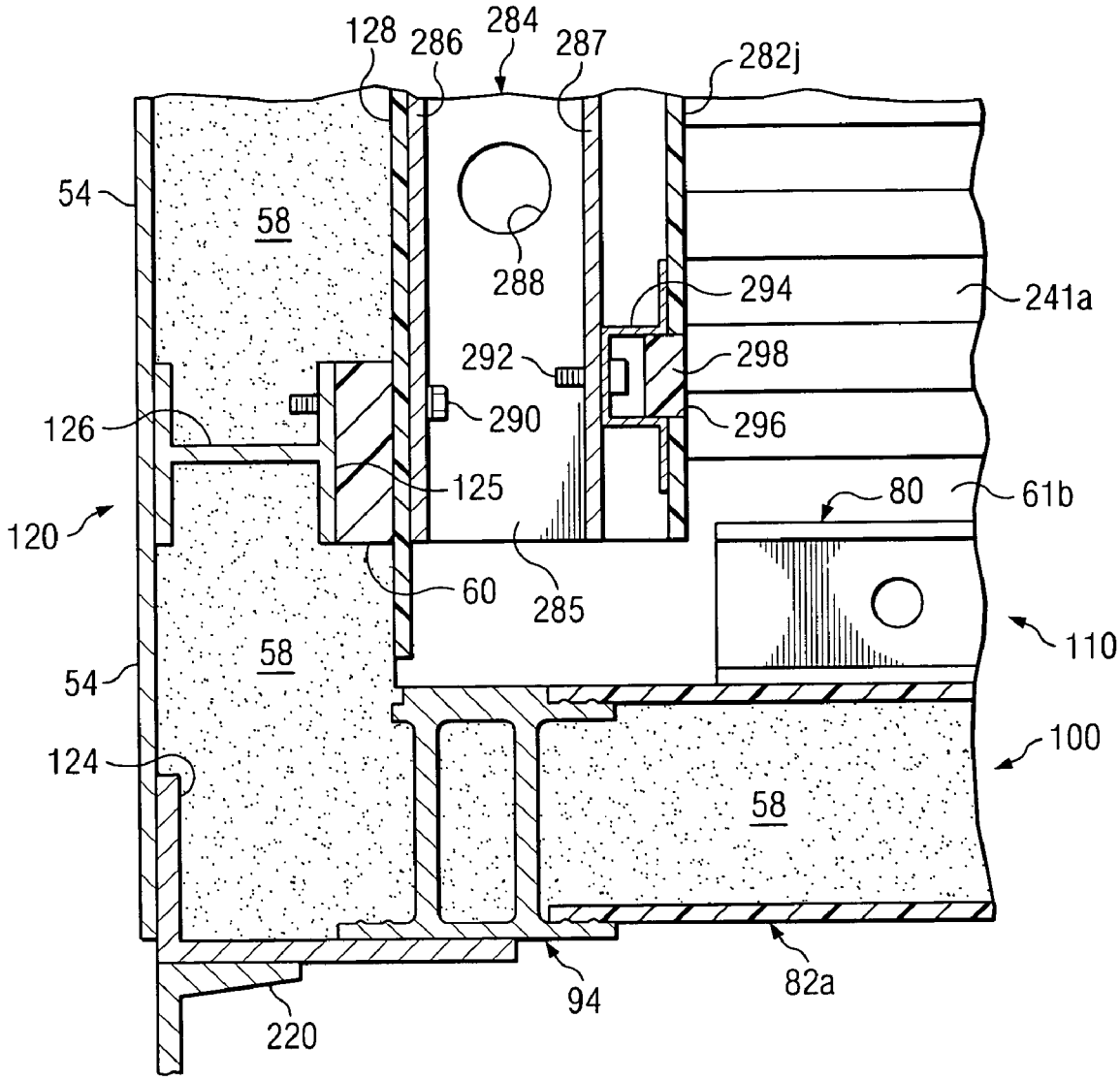
FIG. 4C is a schematic drawing in section and in elevation with portions broken away showing portions of an endwall assembly and floor assembly incorporating teachings of the present invention.

As shown in FIG. 3 the length of each panel 282 corresponds generally with the interior width of composite box structure 30. The width or height of each panel 282 may vary as shown in FIG. 3. For purposes of describing various features of the present invention, channels 282 have been designated as 282*a*-282*j*. For some applications, panels 282*a* through 282*d* may include recessed handles (not expressly shown) disposed in openings or slots 299. Slots 299 and associated handles allow removal of panels 282*a* through 282*d* to gain access to refrigeration unit 142 through opening 127.

Interior bulkhead or end barrier 380 may be formed within composite box structure 30 and attached to endwall assembly 122 to form airflow paths therebetween. See FIG. 4B. Interior bulkhead 380 may include a plurality of panels 382 which extend substantially vertically between roof assembly 40 and floor assembly 80. For some applications each panel 382 may have approximately the same length, width and thickness (not expressly shown). Scuff plates (not expressly shown) may also be disposed on interior bulkhead 380.

Panels 382 may be formed from the same materials as used to form panels 282. Channels or open beams 394 may be bonded with respective panels 382. For some applications channels 394 may be described as having a "hat-shaped" cross section. A plurality of holes or openings (not expressly shown) may be formed in each panel 382. The location of the holes may be selected to correspond with associated end beams 126 of endwall assembly 122. Channels 394 and associated openings may extend generally vertically along opposite longitudinal edges of each panel 382. The openings and associated channels 394 cooperate with each other to allow fasteners (not expressly shown) to be inserted through the holes, associated channels 394 and securely engaged with adjacent end beams 126. Channels 394 may be formed from metal alloys such as aluminum or composite materials. The same types of mechanical fasteners used to attach panels 282 with support beam 284 may also be used to attach panels 382 with portions of adjacent end beams 126.

Channels 394 provide airflow paths from plenum 310 to floor assembly 80. The offset between panels 382 and endwall assembly 122 provides additional airflow paths from plenum 310 to floor assembly 80. The second end of plenum assembly 310 may be coupled with endwall assembly 122 and adjacent interior bulkhead 380 to direct airflow from plenum assembly 310 to the airflow paths formed between interior bulkhead 380 and endwall assembly 122.

Sidewall assemblies 50 and 52 may have substantially the same configuration and overall design. Layers 61 associated with sidewall assemblies 50 and 52 preferably includes a corrugated cross section which provides recessed portions or channels 63 disposed between adjacent support posts 56. See FIGS. 5, 6 and 7. For some applications channels 63 may have a width between approximately four (4) and five (5) inches and a depth of approximately one-half of one inch (½"). The corrugated cross section of layers 61 and channels 63 form portions of airflow management system 300.

Layers 45 associated with roof assembly 40 and layers 128 associated endwall assemblies 120 and 122 may be formed from the same material as layer 61. However, layers 45 and 128 will generally not include corrugations or channels 63. Layers 45, 61 and 128 may be formed from tough, lightweight, relatively rigid material having high impact resistance available from U.S. Liner Company, a division of American Made, Inc. under the trademark Bulitex®. Bulitex® material may be generally described as a ballistic grade composite scuff and wall liner.

Various types of ballistic resistant fabric may also be satisfactorily used to provide layers 45, 61 and 128 for a composite box structure incorporating teachings of the present invention. Ballistic resistant fabrics are often formed with multiple layers of woven or knitted fibers. The fibers may be impregnated with low modulus elastomeric material as compared to the fibers which preferably have a high modulus. U.S. Pat. No. 5,677,029 entitled "Ballistic Resistant Fabric Articles" and assigned to Allied Signal shows one example of a ballistic resistant fabric.

Foam insulation 58 is preferably disposed between adjacent side posts 56 and bonded with interior surface 55 of side sheets 54, the interior surface of layers 61 and adjacent portions of support posts 56. For some applications a layer of scrim (not expressly shown) may be attached to the interior surface of each layer 61 to enhance bonding with foam insulation 58. The scrim may be a nonwoven fabric or any other suitable material for bonding with foam insulation 58. Layer 61 may also be nailed and/or adhesively bonded with isolators 60.

Figure 5:
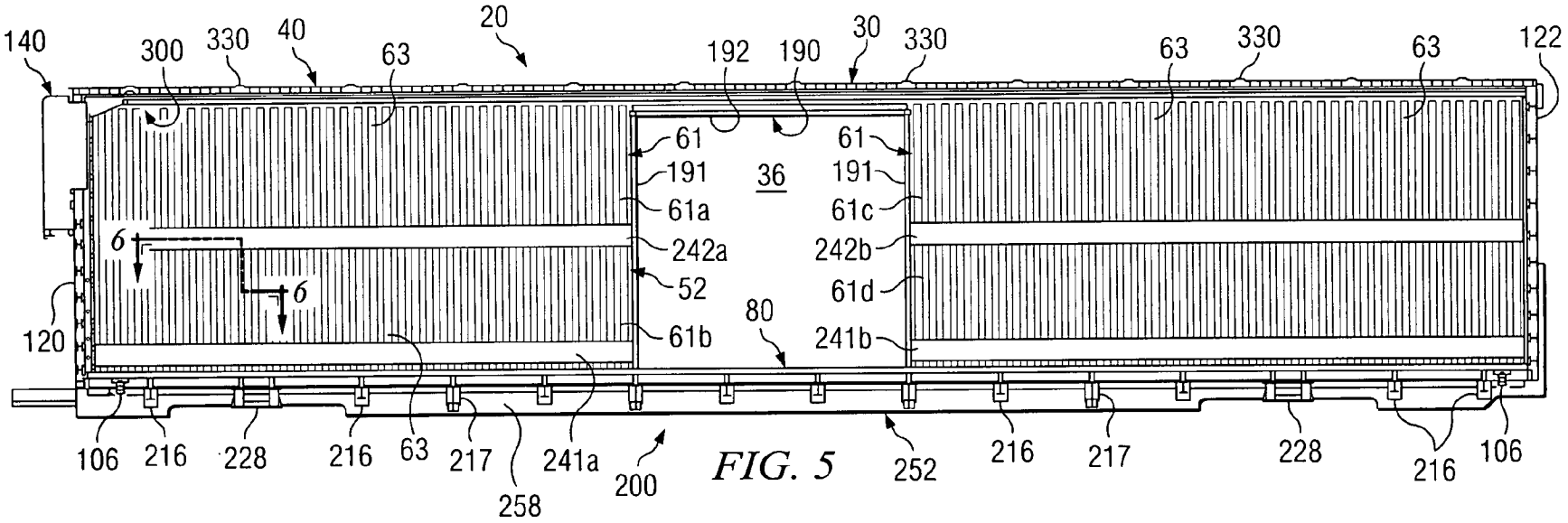
FIG. 5 is a schematic drawing in section with portions broken away taken along lines 5-5 of FIG. 1B showing an interior view of a composite box structure incorporating teachings of the present invention.
Figure 6:
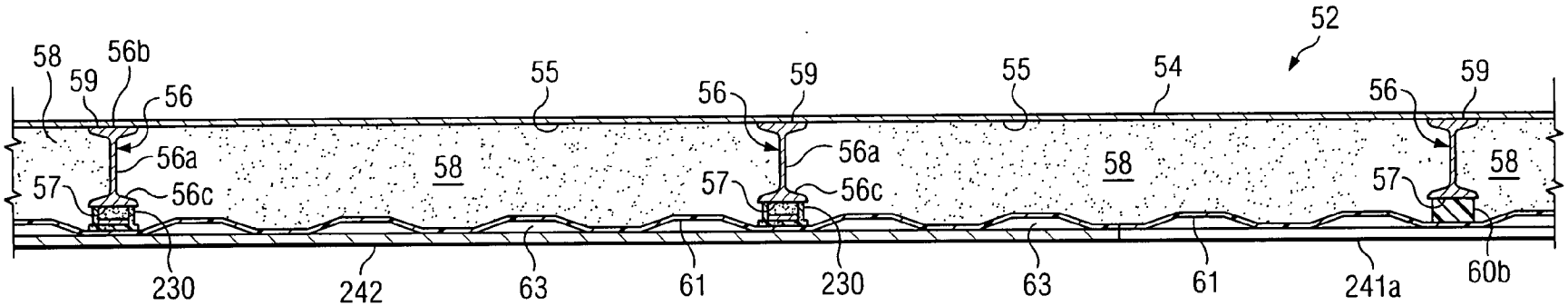
FIG. 6 is a schematic drawing in section with portions broken away taken along lines 6-6 of FIG. 5 showing portions of a sidewall assembly incorporating teachings of the present invention.

For some applications layer 61 may be applied to interior portions of respective sidewall assemblies 50 and 52 in multiple segments or strips. As shown in FIG. 5, sidewall assembly 52 may be fabricated with upper strip or a first segment 61*a* attached to interior portions of sidewall assembly 52 adjacent to roof assembly 40 extending from endwall assembly 120 to door opening 36. Lower strip or second segment 61*b* may be attached to interior portions of sidewall assembly 52 adjacent to floor assembly 80 extending from endwall assembly 120 to door opening 36. In a similar manner upper strip or third segment 61*c* may be attached to interior portions of sidewall assembly 52 adjacent to roof assembly 40 extending from endwall assembly 122 to door opening 36. Lower strip or fourth segment 61*d* may be attached to interior portions of sidewall assembly 52 adjacent to floor assembly 80 extending from endwall assembly 122 to door opening 36.

A first end of each support post 56 may be attached to adjacent portions of associated top chord 64. See FIG. 12. Top chords 64 extend longitudinally along the respective upper edge of sidewall assemblies 50 and 52. Top chords 64 may sometimes be referred to as "top plates". Each top chord 64 may have a generally inverted "L-shaped" cross section defined in part by leg 66 and leg 68 extending therefrom. The upper portion of adjacent side sheets 54 may be attached with leg 66 of each of associated top chord 64.

A second end of each support post 56 may be attached to adjacent portions of respective side sill assemblies 250 or 252. Support posts 56, top chords 64 and respective side sill assemblies 250 or 252 cooperate with each other to define a generally elongated, rectangular configuration corresponding with associated sidewall assemblies 50 and 52.

A plurality of metal sheets 54 may be attached with each sidewall assembly 50 and 52 using conventional welding techniques and/or mechanical fasteners. Side sheets 54 cooperate with each other to form exterior surfaces of sidewall assemblies 50 and 52 and composite box structure 30. Respective side stakes or support posts 56 may be attached to interior surface 55 of each side sheet 54. Support posts 56 generally project toward the interior of composite box structure 30. For some embodiments each support post 56 may have the general cross section of an I-beam defined in part by web 56*a* and flanges 56*b* and 56*c*. Flange 56*b* includes exterior surface 59 of each post 56. Flange 56*c* includes interior surface 57 of each post 56. See FIG. 6.

Figure 7:
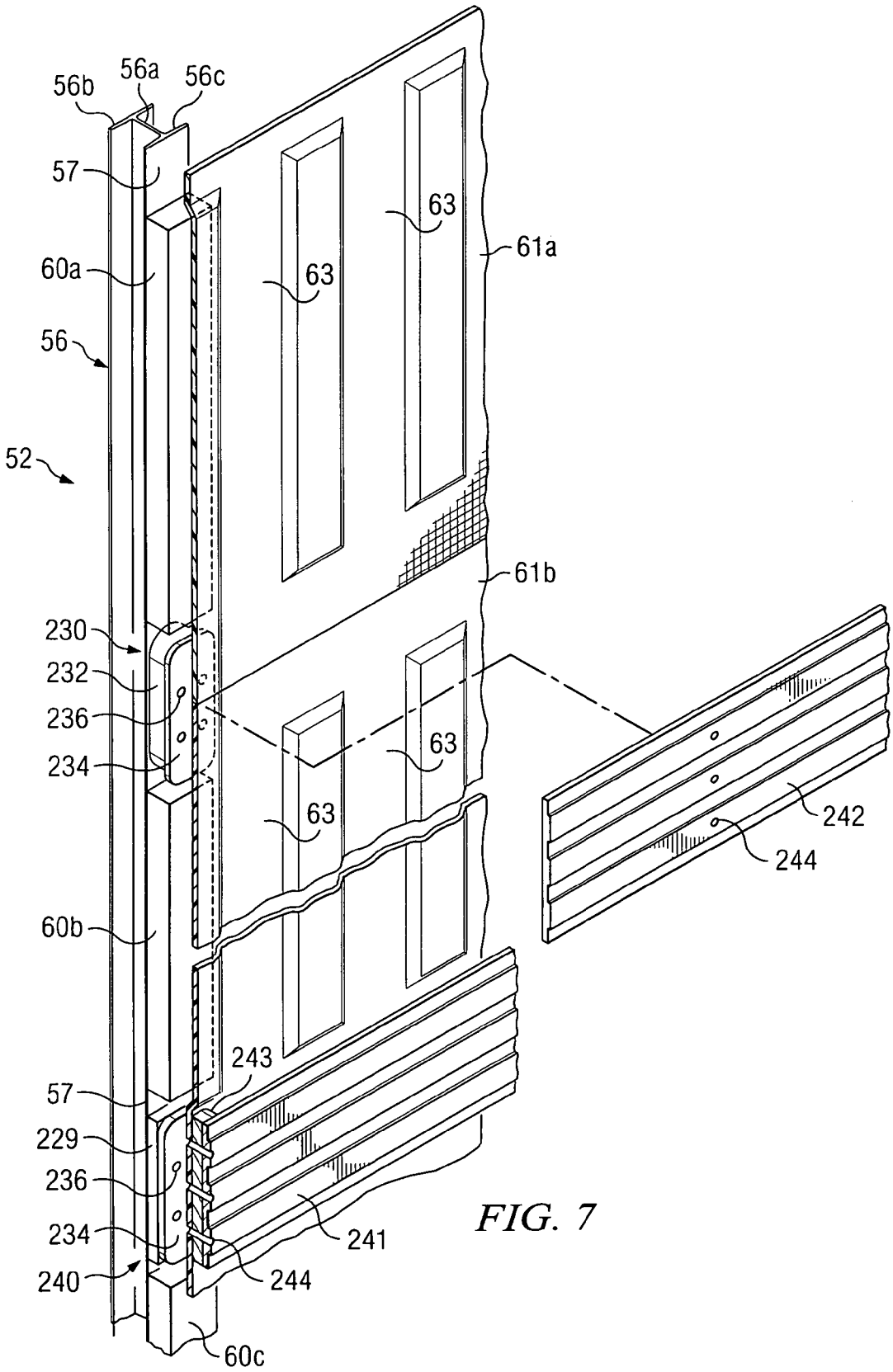
FIG. 7 is a schematic drawing showing an exploded isometric view with portions broken away of a sidewall assembly, associated scuff plate support assemblies and scuff plates.

Isolators 60 may be formed from strips of thermoplastic polymers such as polyvinyl chloride (PVC) insulating material and attached to interior surface 57 of support posts 56. For applications such as shown in FIG. 7, first isolator 60*a*, second isolator 60*b*, and third isolator 60*c* may be formed from blocks of urethane foam and attached to and securely bonded with interior surface 57 of associated support post 56. Urethane foam blocks may sometimes be described as a "semi-structural material". Urethane foam blocks may have better insulation characteristics as compared with polyvinyl chloride insulating materials but may also have reduced structural strength as compared with polyvinyl chloride blocks. Various insulating materials may be attached to interior surface 57 of support posts 56. The present invention is not limited to use of PVC strips, PVC blocks or urethane foam blocks.

As shown in FIG. 7 isolators 60*a* and 60*b* and scuff plate support assembly 230 may be attached to interior surface 57 of each support post 56 with scuff plate support assembly 230 disposed between associated isolators 60*a* and 60*b*. Isolator 60*c* and scuff plate support assembly 240 may also be attached to interior surface 57 of each support post 56 disposed between isolators 60*b* and 60*c*. Scuff plate support assemblies 230 and 240 may be used to attach respective scuff plates 242 and 241 with the interior of sidewall assemblies 50 and 52. Additional information concerning support assemblies 230 and 240 may be found in U.S. patent application Ser. No. 11/009,128 filed Dec. 10, 2004, entitled "Temperature Controlled Railway Car," now U.S. Pat. No. 7,228,805.

For some applications scuff plate support assembly 230 may include housing 232 with an isolator (not expressly shown) disposed therein. Housing 232 and the associated isolator may substantially reduce heat transfer between scuff plate 242 and adjacent support post 56. Scuff plate support assembly 230 may also include attachment plate 234 disposed on housing 232. Holes 236 may be formed in each attachment plate 234 to engage respective scuff plate support assembly 230 with associated support post 56. After sidewall assemblies 50 and 52 have been securely mounted on railway car underframe 200, scuff plates 242 may be attached with associated support assembly 230. Bolts, screws or Huck® fasteners may be inserted through respective openings 244 in each scuff plate 242 to securely engage scuff plates 242 with associated attachment plates 238.

For some applications, each scuff plate support assembly 240 may include respective isolator or block 229 with respective attachment plate 234 disposed thereon. Openings or holes 236 may be formed in each attachment plate 234 to engage respective scuff plate support assembly 240 with associated support post 56. For some applications, support blocks 229 may be formed from PVC foam. Support blocks 229 may be bonded with flange 56*c* using various types of adhesive. Bolts, screws or Huck® fasteners may be inserted through openings 236 to securely engage each attachment plate 234 with associated support post 56. Various types of mechanical fasteners may be inserted through respective openings 244 in each scuff plate 241 to securely engage scuff plates 241 with associated attachment plates 234.

For embodiments such as shown in FIGS. 3, 4A, 4B, 5, 6 and 7 respective scuff plates 241 may be disposed adjacent to the interior of each sidewall assembly 50 and 52 proximate floor assembly 80. Respective scuff plates 242 may be disposed adjacent to the interior of each sidewall assembly 50 and 52 between floor assembly 80 and roof assembly 40. A plurality of support assemblies 240 may be mounted on interior surface 57 of each support post 56. The location of support assemblies 240 may be selected to correspond with the desired location for scuff plates 241 relative to floor assembly 80. A plurality of support assemblies 230 may be mounted on interior surface 57 of each support post 56. The location of support assemblies 230 may be selected to correspond with the desired location for scuff plates 242 relative to associated scuff plates 241 and floor assembly 80.

Scuff plates 241 and 242 may be installed in segments with first segments 241*a* and 242*a* extending from endwall assembly 120 to door opening 36 and second segments 241*b* and 242*b* extending between door opening 36 and endwall assembly 122. Scuff plates 241 and 242 may be formed from aluminum alloys or any other material having desired wear characteristics to minimize damage to interior surfaces of the associated sidewall assemblies 50 and 52.

For some applications scuff plates 241 may be directly disposed on layers 61*b* or 61*d* and securely engaged with associated attachment plates 234. For other applications spacers 243 may be attached to scuff plates 241 to provide an offset between each scuff plate 241 and adjacent portions of layers 61*b* or 61*d* to accommodate airflow therebetween. Additional spacers 243 may be attached to each scuff plate 241 to contact layers 61*b* or 61*d* between adjacent support posts 56. For some applications spacers 243 may be disposed on scuff plates 241 at a distance of approximately fifteen inches from each other.

Corrugations 63 formed in segments 61*b* and 61*d* may extend along substantially the full height of each layer 61*b* and 61*d* from floor assemblies 80. For other applications such as shown in FIG. 7 corrugations 63 in segments 61*b* and 61*d* may terminate at a location above associated scuff plate 241. The configuration and dimensions associated with support block 229 and attachment plate 234 and the use of spacer 243 may be varied depending on the configuration of corrugations 63 formed in associated layers 61*b* and 61*d*.

Upper layers such as 61*a* or 61*c* may have generally rectangular configurations with an overall length of approximately three hundred seventy eight inches, a width of approximately ninety eight inches and a thickness of approximately 0.08 inches. Upper and lower portions of layers 61*a* and 61*c* may be relatively flat with corrugations 63 space therefrom. Lower layers such as 61*b* and 61*d* may have a similar length but a reduced width of approximately fifty five inches. Also, the length of corrugations 63 in layers 61*b* and 61*d* may be substantially reduced as compared with the length of the corrugations 63 in layers 61*a* and 61*c*.

Sidewall assemblies 50 and 52 preferably include respective openings 36 and respective door assemblies 180 slidably mounted thereon. See FIGS. 1A, 5 and 12. Each door assembly 180 has a first position blocking respective opening 36 to form a barrier between interior and the exterior of composite box structure 30. Each door assembly 180 also has a second position which allows access to interior of composite box structure 30 through respective opening 36. Various types of doors may be satisfactorily used with composite box structure 30, including doors fabricated from steel and/or wood, or doors fabricated from composite materials. Door closing bracket 209 and door opening bracket 211 may be disposed on the exterior of each sidewall assembly 50 and 52 to assist with opening and closing of associated door assemblies 180.

Door assembly 180 may be formed from materials with thermal insulation characteristics corresponding with the associated sidewall assemblies 50 and 52. See FIGS. 1A and 13. Steel door 182 may be used to form exterior portions of door assembly 180. The length of steel door 182 corresponds approximately with the height of associated opening 36. The width of steel door 182 corresponds approximately with the width of opening 36. Liner 185 may be attached to and bonded with interior surfaces of steel door 182. Liner 185 may be formed from various types of insulating materials including urethane foam with heat transfer characteristics similar to insulating materials 58. Layer 187 of fiber reinforced material with corrugations or channels 63 formed therein may also be attached to liner 185 opposite from steel door 182.

The combined thickness of liner 185 and steel door 182 may be selected to approximately equal the thickness of associated sidewall assemblies 50 and 52. The length of a crank arm (not expressly shown) associated with each door assembly 180 may be selected to allow liner 185 to satisfactorily clear adjacent portions of door frame assembly 190 and the associated sidewall assemblies 50 and 52 when door assemblies 180 are moved between their first closed position to their second open position. Steel door 182 may be obtained from various vendors such as Youngstown Steel Door. Liner 185 may be obtained from various manufacturers such as Martin Marietta Corporation.

Each door assembly 180 may be mounted on respective sidewall assemblies 50 and 52 using conventional hardware such as operating pipes, operating mechanisms, rollers, locking bars, gears and cams associated with conventional railway boxcars. Such items may be obtained from several vendors including YSD Industries, Inc. (Youngstown Steel Door), and Pennsylvania Railcar.

Figure 13:
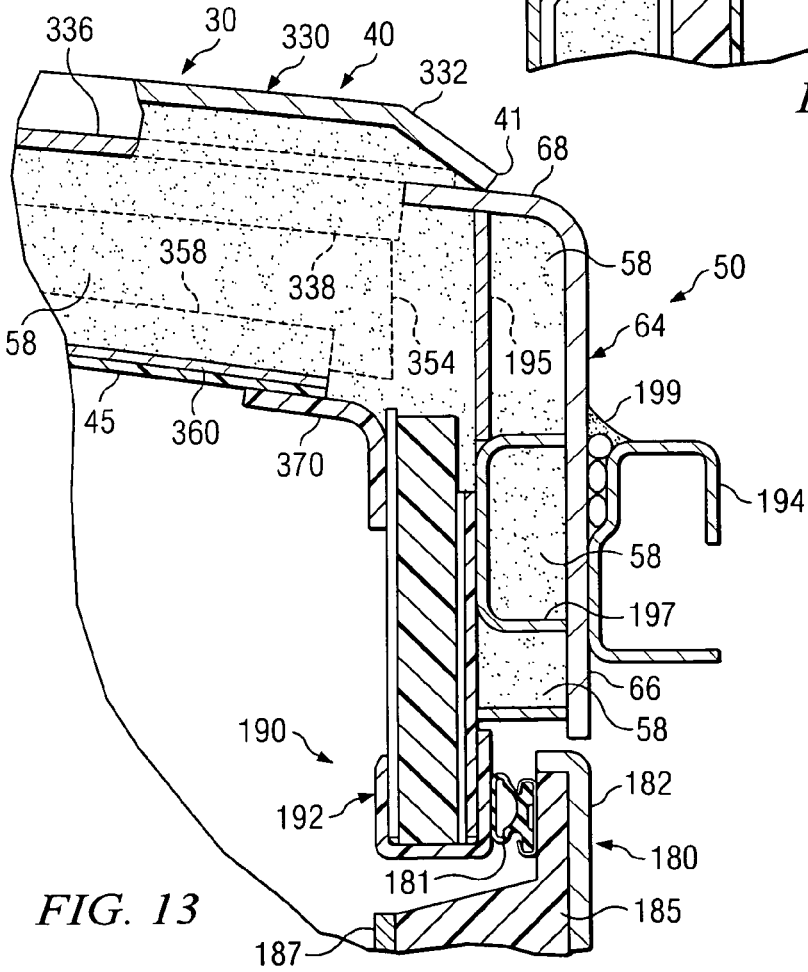
FIG. 13 is a schematic drawing in section with portions broken away showing portions of a roof assembly and a door assembly mounted on a sidewall assembly incorporating teachings of the present invention.

Portions of door frame assembly 190, which may be satisfactorily used with door assembly 180, are shown in FIGS. 1A, 5 and 13. Typically, each door assembly 180 will be slidably mounted on upper track 194 and lower track 196 which are attached adjacent to respective openings 36. See FIG. 1A. Door frame assembly 190 may include upper track 194, adjacent portions of top chord 64, C-shaped channel 197, plate 195 and other components such as shown in FIG. 13. Upper track 194 may be attached with adjacent portions of top chord 64. Sealing material 199 may be disposed between upper track 194 and leg 66 of top chord 64. Various welding techniques and/or mechanical fasteners may be used as desired.

As shown in FIG. 5, door frame assembly 190 may be attached to the perimeter of each opening 36 formed in respective sidewall assemblies 50 and 52. Each door frame assembly 190 may include a pair of vertical door post assemblies 191 and door header or door retainer 192. Upper door track 194, lower door track 196, and a threshold (not expressly shown) may also be installed adjacent to each door frame assembly 190. Vertical door post assemblies 191 may be securely attached with adjacent portions of sidewall assemblies 50 and 52. Door header 192 may be disposed between and attached to vertical door post assemblies 191 at the top of each opening 36.

Portions of each door frame assembly 190 may be offset from the exterior of associated sidewall assemblies 50 and 52 to receive respective door assemblies 180. A corresponding offset (not expressly shown) may also be formed in adjacent portions of thresholds (not expressly shown) at respective openings 36. The resulting offsets at each opening 36 accommodate door frame assembly 190 and particularly door post assemblies 191 to allow the associated door assembly 180 and its operating mechanism to fit within the applicable AAR clearance envelope.

Metal plates (not expressly shown) and/or an elastomeric thresholds may be disposed within the lower portion of each opening 36 adjacent to floor assembly 80. The metal plates and/or threshold may be formed from steel alloys, aluminum alloys, ceramic materials and/or composites of these materials.

Elastomeric gasket 181 may be attached adjacent to the interior perimeter of each door assembly 180. Elastomeric gasket 181 preferably contacts adjacent portions of associated door frame assembly 190 when respective door assembly 180 is in its first, closed position. Elastomeric gasket 181 and portions of door frame assembly 190 cooperate with each other to minimize heat transfer between the interior and the exterior of composite box structure 30, when the respective door assembly 180 is in its first, closed position. Door stops 266 and 268 may be mounted on the exterior of each sidewall assembly 50 and 52 to limit movement of the associated door assembly 180 from its first position to its second position.

Floor assembly 80 as shown in FIGS. 3, 4A, 4B, 8, 9 and 10 may include primary floor assembly 100 and secondary floor assembly 110. For some applications a plurality of panels 82 may be bonded with each other to form primary floor 100 having a generally rectangular configuration corresponding with desired interior length and width of composite box structure 30. The length of each panel 82 may correspond approximately with the desired interior width of composite box structure 30. The width of each panel 82 may correspond with the lateral spacing between associated cross ties 216 and cross bearers 217 and body bolsters 224 and 226. See FIG. 2. U.S. Pat. No. 5,716,487 entitled "Pultrusion Apparatus" assigned to Creative Pultrusions, Inc. describes one example of equipment and procedures which may be used to form panels 82.

For purposes of describing various features of the present invention panels 82 may sometimes be designated as 82*a*, 82*b*, etc. Also, most panels 82 will have approximately the same overall dimensions of length, width and thickness. However, some panels 82 such as panels 82*a* installed adjacent to endwall assembly 120 and panel 82*b* installed adjacent to endwall assembly 122 may have modified designs and width to accommodate draining water and other liquids from composite box structure 30.

Panels 829 and 82*h* disposed over body bolsters 224 and 226 may also have a modified design and width. For example, respective panels 82 may be disposed on and bonded with adjacent portions of each body bolster 224 and 226. The respective panels 82 may be spaced from each other by a distance of approximately twelve inches to fourteen inches. After other portions of primary floor assembly 100 have been installed on railway car underframe 200, respective layers or sheets 84*g* and 84*h* may be disposed between adjacent panels 82 and insulating foam injected therebetween to form insulating material 58 in respective panels 82*g* and 82*h*.

For some applications panels 82 may be bonded with each other to form primary floor assembly 100 prior to mounting on railway car underframe 200. Primary floor assembly 100 may then be lowered onto railway car underframe 200 prior to installing roof assembly 40 on sidewall assemblies 50 and 52 and endwall assemblies 120 and 122. Roof assembly 40 may be mounted on sidewall assemblies 50 and 52 and endwall assemblies 120 and 122 after installation of primary floor 100.

For other applications, individual panels 82 or groups of panels 82 may be installed through openings 36 in sidewall assemblies 50 and 52 during assembly of primary floor 100 on railway car underframe 200 after roof assembly 40 has been attached to sidewall assemblies 50 and 52 and endwall assemblies 120 and 122.

Each pultruded panel 82 may include first layer or first sheet 84*a* and second layer or second sheet 84*b* with insulating material 58 disposed therebetween. First sheet 84*a* and second sheet 84*b* preferably have generally rectangular configurations. Longitudinal edge 91 of first sheet 84*a* and longitudinal edge 91 of second sheet 84*b* may be securely engaged with channel 94*a*. Longitudinal edge 92 of first panel 84*a* and longitudinal edge 92 of second panel 84*b* may also be securely engaged with channel 94*b*. See FIGS. 9 and 10. Layers 84*a*, 84*b* and associated channels 94 may be formed from fiber reinforced plastic materials using pultrusion technology.

Channels 94*a* and 94*b* may have generally rectangular cross sections defined in part by webs 95*a* and 95*b* which are spaced from each other and extend generally parallel with each other along the length of associated panels 82. Channels 94*a* and 94*b* may also be described as "double web beams" or "hollow beams." Each channel 94 also includes respective flanges 96*a* and 96*b* which are spaced from each other and extend parallel with each other along the length of associated panels 82. Webs 95*a*, 95*b* and flanges 96*a*, 96*b* cooperate with each other to form a generally void space which may be filled with insulating material 58. The length of each pultruded channel 94 corresponds approximately with the desired interior width of composite box structure 30. The width of flanges 96*a* and 96*b* may be approximately equal to or greater than the width of the associated cross tie 216 or cross bearer 217.

Channels 94 may be formed by various pultrusion techniques. Pultruded channels 94 provide substantial structural strength for primary floor 100 and transfer weight from lading disposed on floor assembly 80 to railway car underframe 200. Placing pultruded channels or double web beams 94 on the cross members of railway car underframe 200 allows the elimination of longitudinal steel stringers associated with some prior railway cars having composite box structures. Channels 94 increase thermal efficiency of floor assembly 80 and allow reduction in the empty car weight of associated railway car 20 by eliminating multiple webs associated with prior pultruded panels and longitudinal stringers associated with some prior railway car underframes.

First sheet 84*a*, second sheet 84*b* and attached channels 94 cooperate with each other to define a void space or cavity which may be filled with insulating material 58 having desired thermal heat transfer characteristics. For some applications, insulating material 58 may be the same as the insulating material used to form sidewall assemblies 50, 52, endwall assemblies 120, 122 and roof assembly 40. Insulating material 58 substantially reduces heat transfer through floor assembly 80. Various types of insulating material such as closed cell urethane foam may be satisfactorily used to fill void spaces associated with channels 94 and sheets 84*a* and 84*b*. Various adhesive compounds (not expressly shown) may be used to bond or couple sheets 84*a* and 84*b* with associated channels 94 and adjacent pultruded panels 82 with each other.

Respective cover plates or end caps 98 may be placed on ends 81 and ends 83 of panels 84*a* and 84*b* to close the cavity formed between layer 84*a* and 84*b* and the cavity formed in associated channels 94. Holes 99 may be provided in cover plates 98 to allow injection of liquid foam insulation into associated cavities. Cover plates 98 also prevent moisture or other contaminants from contacting insulating material 58 and reducing associated thermal insulating characteristics. Any moisture or liquids which enter void spaces associated with panels 82 or channels 94 may cause an undesired increase in weight of the associated pultruded panel 82. For some applications cover plates 98 may be formed with a generally rectangular configuration corresponding generally with dimensions of respective ends 81 and ends 83. See FIG. 10.

Various techniques and procedures may be used to attach or couple primary floor assembly 100 with cross members 216, 217, 224, 226 and/or side sills 250 and 252 and end sills 220 and 222. During loading and unloading of railway car 20, portions of secondary floor 110 may be substantially fully loaded while other portions of secondary floor assembly 110 may be empty or in a no load condition. To prevent tilting or undesired movement secondary floor assembly 110 is preferably bonded with primary floor assembly 100. For some applications biodegradable adhesive compounds or other structural adhesives may be used to bond or couple pultruded panels 82 with each other, to bond primary floor assembly 100 with railway car underframe 200 or to bond secondary floor assembly 110 with primary floor assembly 100. Also, two-part epoxy adhesives or double epoxy adhesives may be used to bond panels 82 with each other and to bond primary floor assembly 100 with adjacent portions of railway car underframe 200. The same two part epoxy glue may also be satisfactorily used to bond secondary floor assembly 110 with adjacent portions of primary floor 100. One example of an adhesive satisfactory for use in forming floor assembly 80 includes PLIOGRIP® adhesive available from Ashland Chemical.

Pultruded panels 82*a* and 82*b* may include one or more drain openings with respective drain plug assembly 106 disposed in respective drain trough or recess 103. Various types of commercially available drain plugs and drain pipes may be satisfactorily used. Drain plug assemblies 106 may be opened to allow cleaning the interior of composite box structure 30. patent application entitled "Temperature Controlled Railway Car" patent application Ser. No. 11/009,128 filed Dec. 10, 2004, now U.S. Pat. No. 7,228,805 contains more details concerning drain plug assembly 106.

Placing channels 94 on associated cross members allows reducing the thickness of associated webs 95*a*, 95*b* and sheets 84*a* and 84*b*. Also, the thickness of foam 58 disposed between sheets or layers 84*a* and 84*b* may be increased. As a result the heat transfer rating of floor assembly 80 may be increased while at the same time reducing the overall weight of floor assembly 80 and railway car underframe 200 as compared with railway cars which require the use of longitudinal stringers disposed on associated cross members.

Figure 8:
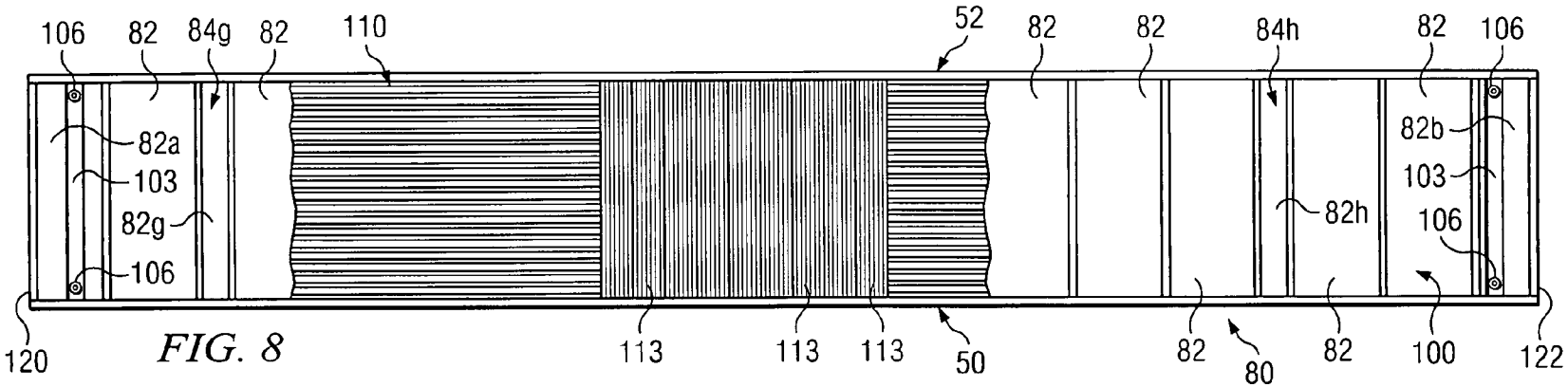
FIG. 8 is a schematic drawing with portions broken away showing a plan view of a floor assembly incorporating teachings of the present invention.
Figure 11:
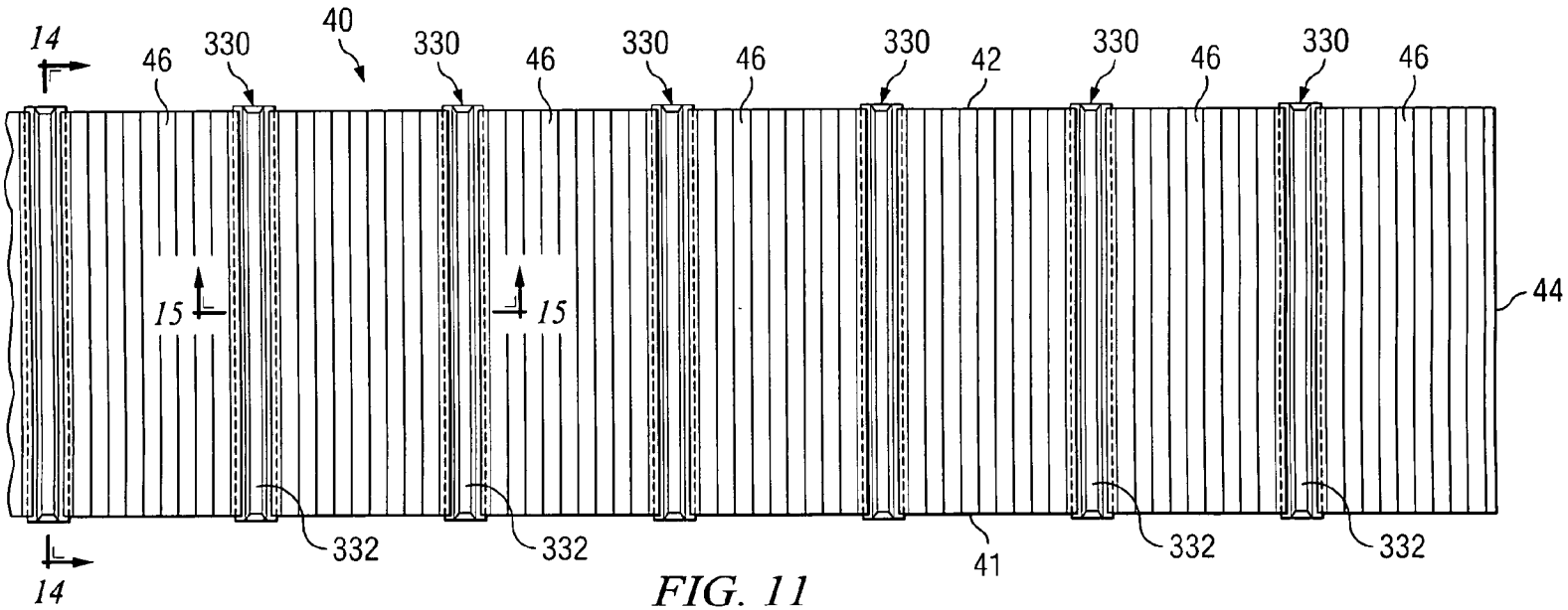
FIG. 11 is a schematic drawing with portions broken away showing a plan view of a roof assembly incorporating teachings of the present invention.

FIG. 8 shows a plan view of floor assembly 80 with portions of secondary floor assembly 110 broken away to expose adjacent portions of primary floor assembly 100. For some applications, secondary floor assembly 110 may include a plurality of deck plates 113 installed adjacent to respective openings 36 in sidewall assemblies 50 and 52. Deck plates 113 may be particularly useful adjacent to openings 36 to accommodate movement of forklifts (not expressly shown) during loading and unloading of railway car 20. Deck plates 113 preferably include rough surface or serrations 115 to provide traction for forklifts or people walking thereon.

FIGS. 3, 4A, 4B, 8 and 9 show portions of secondary floor assembly 110 disposed on primary floor assembly 100 opposite from railway car underframe 200. Secondary floor assembly 110 may be formed by placing a plurality of support beams 112 and 112*a* on pultruded panels 82 opposite from railway car underframe 200. Beams 112 and 112*a* preferably disposed normal or perpendicular to associated cross members of railway car underframe 200 and extend longitudinally along the length of floor assembly 80. Beams 112 and 112*a* are spaced from each other across the width of floor assembly 80.

Support beams 112 and 112*a* may have configurations or cross sections corresponding with typical I beams. A plurality of deck plates 113 may be disposed on flanges 111*a* of support beams 112*a*. For some applications flange 111 of each support beam 112 may have rough surface or serrations 115 to provide traction. Flange 116 of beams 112 and flange 116*a* of beams 112*a* may be adhesively bonded or coupled with portions of first layer 84*a* of adjacent pultruded panels 82.

Beams 112*a* may be installed adjacent to openings 36 in sidewall assemblies 50 and 52. Web 114*a* of beams 112*a* preferably have a reduced height as compared with web 114 of beams 112. The difference in height between webs 114 and webs 114*a* is selected to be approximately equal to the thickness of deck plates 113. As a result, secondary floor assembly 110, will provide a relatively uniform transition between deck plates 113 and rough surface 115 of adjacent beams 112.

Figure 9:
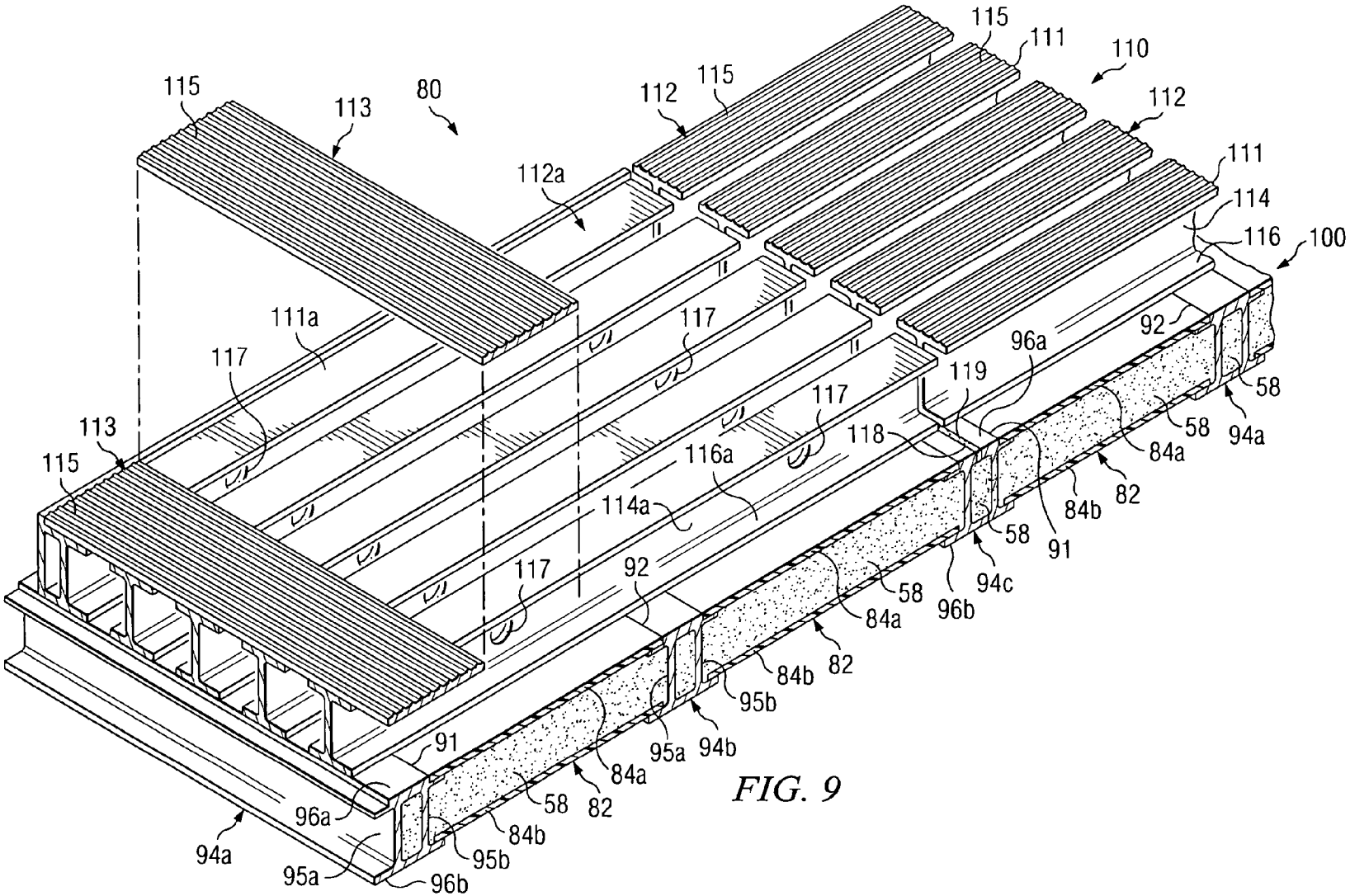
FIG. 9 is a schematic drawing showing an exploded isometric view with portions broken away of a floor assembly which may be assembled on a railway car underframe during manufacture of a railway car in accordance with teachings of the present invention.
Figure 10:
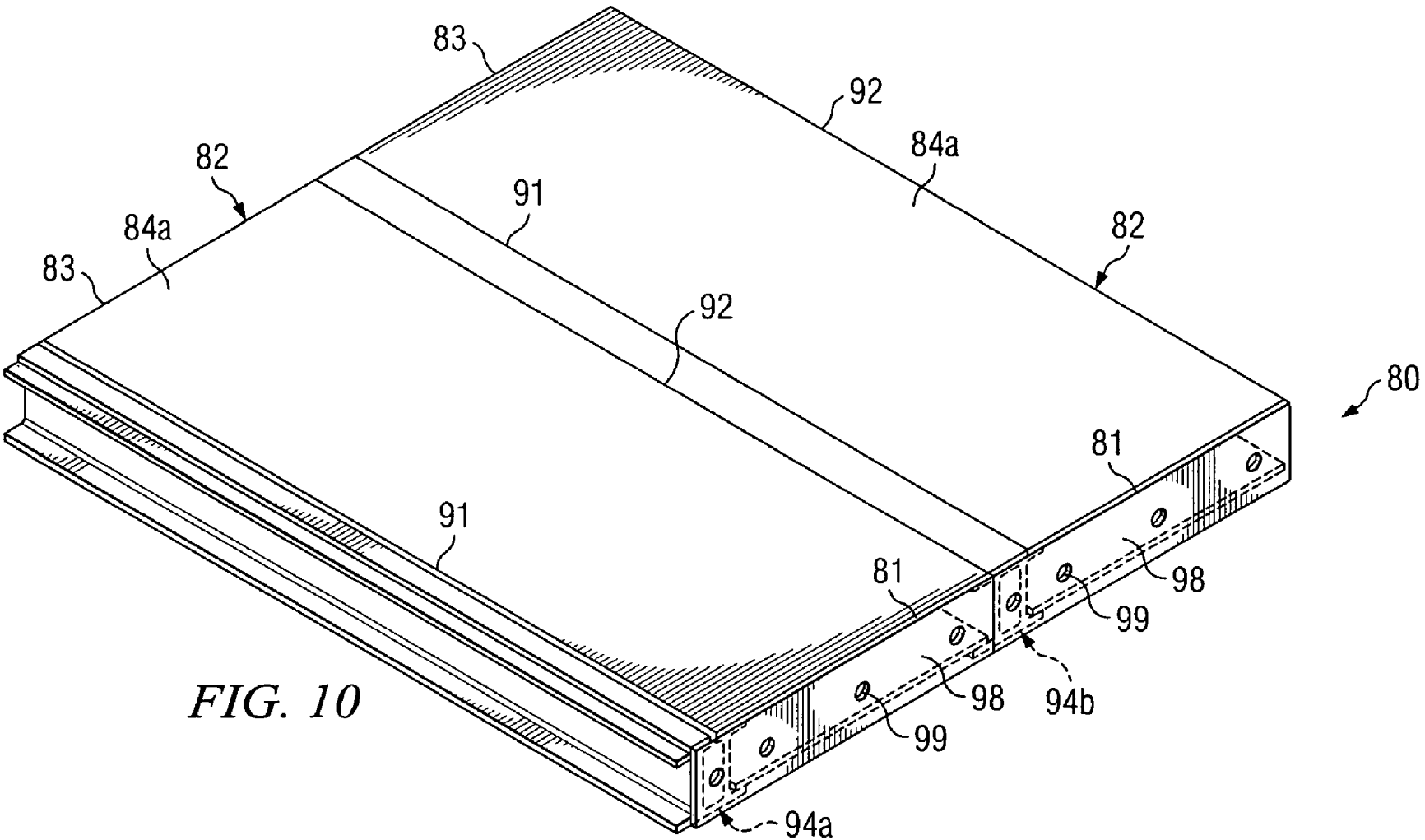
FIG. 10 is a schematic drawing showing an isometric view of panels which may be used to form portions of a floor assembly for a railway car incorporating teachings of the present invention.

Deck plates or coverings 113 may be adhesively bonded with flange 111*a* of support beams 112*a*. Deck plates 113 may also be mechanically attached to support beams 112*a* using various types of mechanical fasteners such as blind screws, rivets, and/or HUCK fasteners (not expressly shown). For some applications support beams 112, 112*a* and deck plates 113 may be formed from metal alloys such as aluminum alloys or other materials typically associated with forming conventional floors in a railway car. As shown in FIG. 9, a plurality of openings 117 may be formed in support beams 112 and 112*a*. Openings 117 allow airflow or air circulation between primary floor 100 and secondary floor 110.

Floor assembly 80 is preferably formed with pultruded panels 82 extending generally perpendicular or normal to center sill 214. Support beams 112 and 112*a* are preferably disposed on pultruded panels 82 spaced from each other and extending generally perpendicular or normal to pultruded panels 82. For some embodiments secondary floor 110 may be formed using conventional, metal I beams and conventional deck plating or floor coverings. The alternating configuration of primary floor assembly 100 and secondary floor assembly 110 provides a generally strong, rigid structure with opportunities for cost savings and weight reduction from increased use of composite and thermoplastic materials.

For some applications, one or more expansion joints 118 such as shown in FIG. 9 may be formed in primary floor assembly 100. Expansion joints 118 may substantially reduce or eliminate any problems associated with variations in the thermal expansion characteristics of railway car underframe 200, primary floor assembly 100 and secondary floor assembly 110. To compensate for any variations in thermal expansion, slot 119 may be formed in flange 96*a* of one or more channels 94.

Thermal expansion may be of particular concern since railway car underframe 200 will often be formed from steel alloys, primary floor assembly 100 from fiber reinforced materials and secondary floor assembly 110 from aluminum alloys which each have substantially different thermal expansion coefficients. For some applications, such as a railway car having a nominal length of sixty-four (64) feet, two expansion joints 118 may be formed in primary floor assembly 110. For railway cars having a greater length more expansion joints 118 may be provided.

For embodiments such as shown in FIG. 9 channels 94*c* preferably include respective expansion joint 118. For some applications channels 94*c* and associated expansion joints 118 may be located at the transition between beams 112*a* and beams 112 of secondary floor assembly 110. The end of adjacent beams 112*a* and 112 are preferably disposed adjacent to slot 119 but do not overlap slot 119. As result of including two expansion joints 118 and a gap between beams 112*a* and 112, floor assembly 80 may be divided into three components or segments which can expand or contract with respect to each other.

The pultruded materials used to form channels or beams 94*c* preferably have satisfactory strength to allow flexing of associated webs 95*a* and 95*b* during variations in temperature. Flexible caulking material may be disposed in slot 119. Expansion joints 118 may also be particularly important when railway car 20 is manufactured at one temperature and used at a different temperature such as minus twenty degrees Fahrenheit or when railway car 20 is unloaded condition at ambient temperature which can often exceed one hundred fifty degrees Fahrenheit.

Roof assembly 40 may be formed with a generally elongated, rectangular configuration. The length and width of roof assembly 40 corresponds generally with the desired length and width of composite box structure 30. Roof assembly 40 includes first longitudinal edge 41 and second longitudinal edge 42 spaced from each other and extending generally parallel with each other from first lateral edge 43 to second lateral edge 44. Longitudinal edges 41 and 42 are preferably mounted on and attached with adjacent portions of respective sidewall assemblies 50 and 52. Lateral edges 43 and 44 are preferably mounted on and attached with respective endwall assemblies 120 and 122. Various types of metal alloys, composite materials and insulating materials may be satisfactorily used to form roof assembly 40.

Roof assembly 40 may have a generally arcuate configuration extending from first longitudinal edge 41 to second longitudinal edge 42. See FIGS. 1B, 3, 12, 13 and 14. Longitudinal edges 41 and 42 of roof assembly 40 may be disposed on leg 68 of respective top chords 64. For some applications welds (not expressly shown) may be used to securely engage longitudinal edges 41 and 42 of roof assembly 40 with adjacent portions of respective top chords 64.

Figure 12:
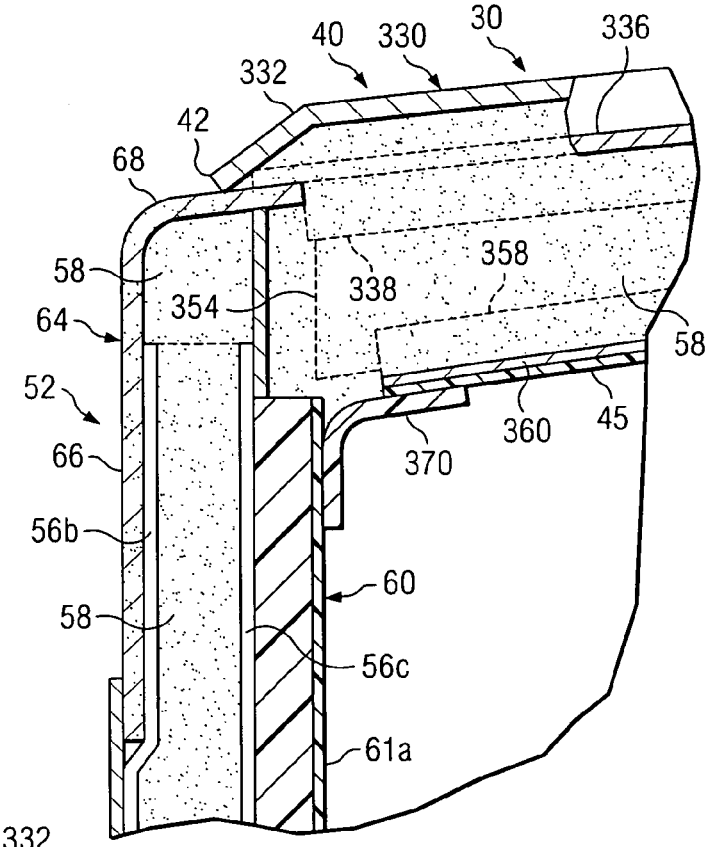
FIG. 12 is a schematic drawing in section with portions broken away showing a joint formed between a roof assembly and a sidewall assembly incorporating teachings of the present invention.

Each endwall assembly 120 and 122 preferably includes a respective top chord or top plate (not expressly shown) attached with upper portions of adjacent metal sheets 54. Roof assembly 40 may be attached to and/or bonded with respective top chords 64 of sidewall assemblies 50, 52 and top chords or top plates of endwall assemblies 120 and 122. As shown in FIGS. 12 and 13, insulating foam may be disposed within joints formed between roof assembly 40 and adjacent portions of sidewall assemblies 50 and 52. An end closure having a generally arcuate shape may also be disposed between respective top plates (not expressly shown) of endwall assemblies 120 and 122 and adjacent portions of roof assembly 40. Trim molding 370 may be bonded with adjacent portions of roof assembly 40 and sidewall assemblies 50 and 52 and adjacent portions of roof assembly 40 and endwall assemblies 120 and 122.

For some applications, roof assembly 40 may be formed with a plurality of carline assemblies 330. See FIGS. 1A, 1B, 3, 5, 11, 12, 13, 14, 15 and 17. Carline assemblies 330 may be generally described as supporting members of roof assembly 40 which extend laterally between respective top chords 64 of sidewall assemblies 50 and 52. Carline assemblies 330 also provide lateral support for sidewall assemblies 50 and 52. The length of each carline assembly 330 may be approximately the same as the width of composite box structure 30.

Each carline assembly 330 preferably includes channel or open beam 332 and support assembly 352. Each channel 332 preferably includes respective flanges 334 and 336 extending therefrom. Channel 332 may be formed from various types of metal alloys such as aluminum alloys or steel alloys satisfactory for use in manufacturing a railway car. Various metal roll forming techniques may be used to fabricate channels 332. For some applications support assemblies 352 may be manufactured from various types of fiber reinforced materials using pultrusion techniques similar to layers or sheets 84*a* and 84*b* of pultruded panels 82 of floor assembly 80. However, support assemblies 352 may be formed from a wide variety of materials using a wide variety of fabrication techniques.

Corrugated metal sheets 46 having generally rectangular configurations may be satisfactorily used to form the exterior portions of roof assembly 40. See FIGS. 12, 13 and 14. Metal sheets 46 may have a length corresponding approximately with the width of composite box structure 30. The width of each metal sheet 46 may approximately equal the desired distance between adjacent carline assemblies 330. For some applications the longitudinal edges of each sheet 46 may be welded or otherwise securely attached with respective flanges 334 and 336 of adjacent carline assemblies 330. The corrugations associated with sheets 46 may be approximately one-sixteenth of an inch (1/16"). See FIG. 15. Sheets 46 may be formed from the same materials as channels 332.

Channels 332 may have various configurations and cross sections. For some applications channels 332 may have a cross section corresponding generally with an open trapezoid compatible with roll forming. Respective web 338 may be attached to and extend from interior portions of each channel 332. Each web 338 may be formed from the same materials as used to form channel 332. For some applications channels 332, webs 338 and sheets 46 may be formed from steel or aluminum alloys.

Support assembly 352 may include coupling 354 formed from fiber reinforced materials. Web 338 and coupling 354 may have generally arcuate configurations corresponding approximately with the radius of curvature of roof assembly 40. See FIG. 15. Each coupling 354 may be attached to associated web 338 using various types of mechanical fasteners such as bolts and nuts 340. See FIGS. 14 and 15.

Support assembly 352 may also include generally "T" shaped support 356. T-shaped support 356 preferably includes rib 358 and flange 360. For some embodiments rib 358 of "T" shaped support 356 may be directly attached to web 338. For other embodiments rib 358 of "T" shaped support 356 may be mechanically attached with coupling 354 opposite from each channel 332. Various types of mechanical fasteners and/or bonding techniques may be satisfactorily used to attach T-shaped support 356 with associated coupling 354 and to attach coupling 354 with associated web 338. Coupling 354 may be particularly useful when pultrusion techniques limit the height of rib 358.

Sheets of fiber reinforced material may be attached with flanges 360 to form layer 45 of roof assembly 40. Insulating material 58 may be bonded with interior portions of channel 332, interior portions of sheets 46 and interior surface 47 of layer 45. Layer 45 provides an interior surface for roof assembly 40.

Figure 14:
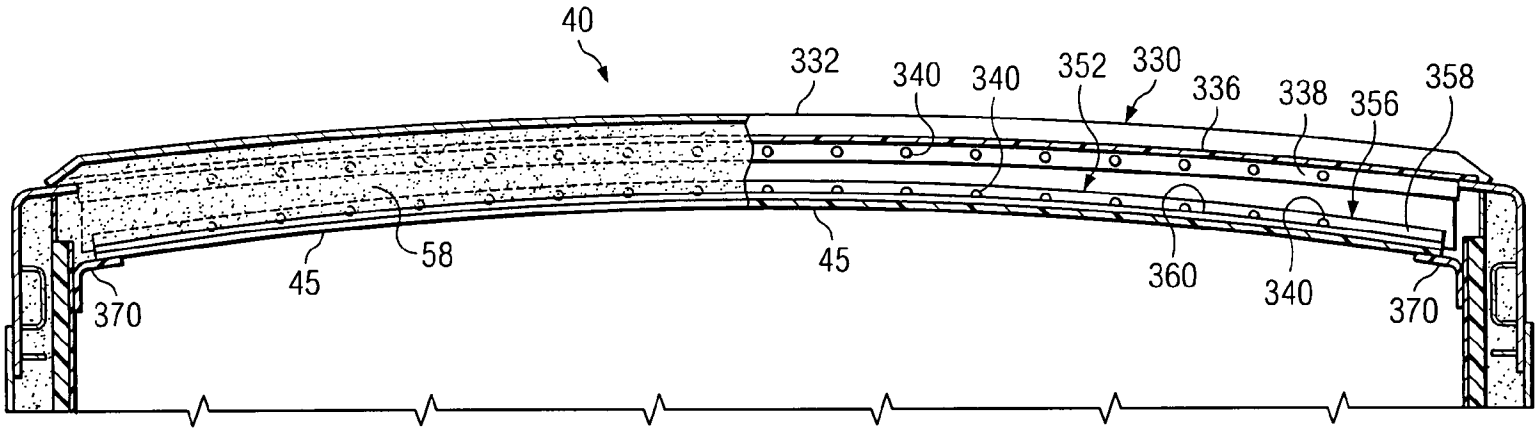
FIG. 14 is a schematic drawing in section with portions broken away taken along lines 14-14 of FIG. 11.
Figure 15:
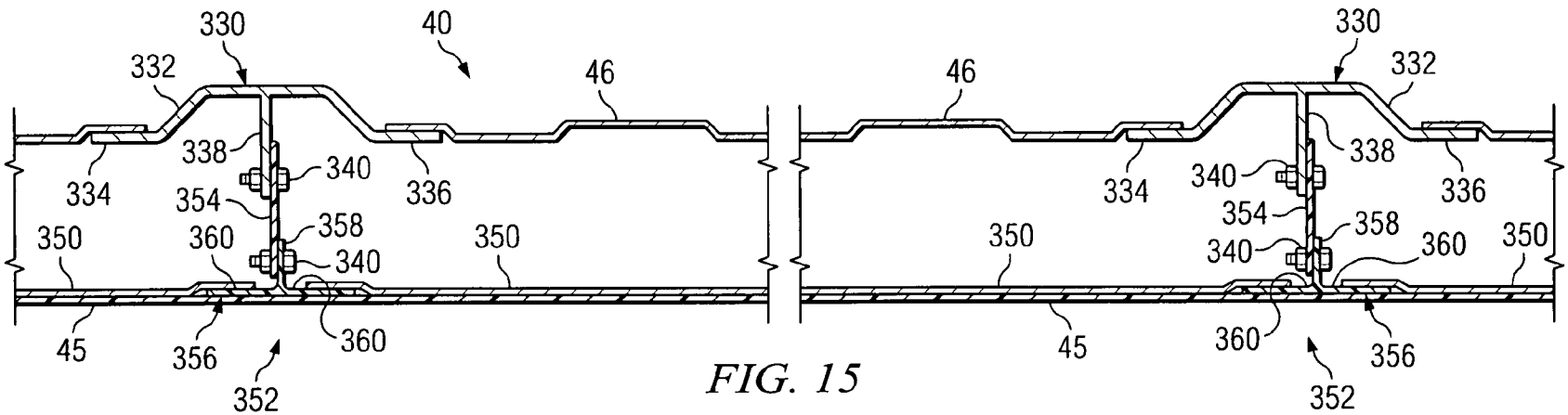
FIG. 15 is a schematic drawing in section with portions broken away taken along lines 15-15 of FIG. 11.

FIGS. 14 and 15 are schematic drawings of roof assembly 40 prior to attachment of plenum assembly 310. For some applications, reinforcing strips 350 may be attached with respective flanges 360 of "T" shaped support 356. Reinforcing strips 350 provide support for attachment of plenum assembly 310. For some applications reinforcing strips 350 may be arranged in three rows spaced laterally from each other and extending approximately the full interior length of roof assembly 40. See FIG. 3. Reinforcing strips 350 may be formed from metal alloys with a width of approximately four inches and thickness of approximately one fourth of an inch. Various types of mechanical fasteners such as self-drilling or self-tapping screws may be used to attach plenum assembly 310 with reinforcing strips 350.

Figure 16:
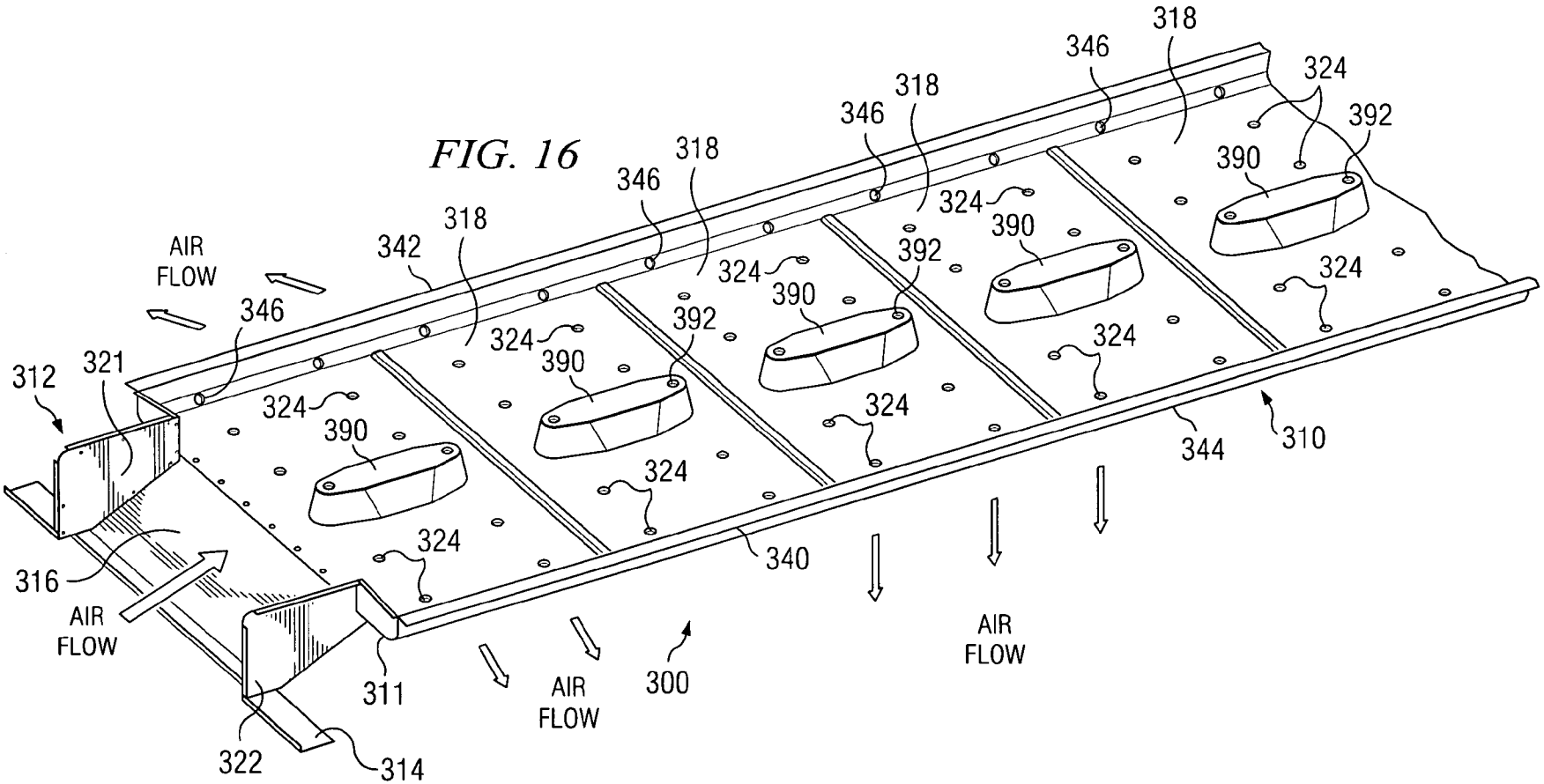
FIG. 16 is a schematic drawing showing an isometric view with portions broken away of a plenum assembly satisfactory for use with a roof assembly incorporating teachings of the present invention.
Figure 17:
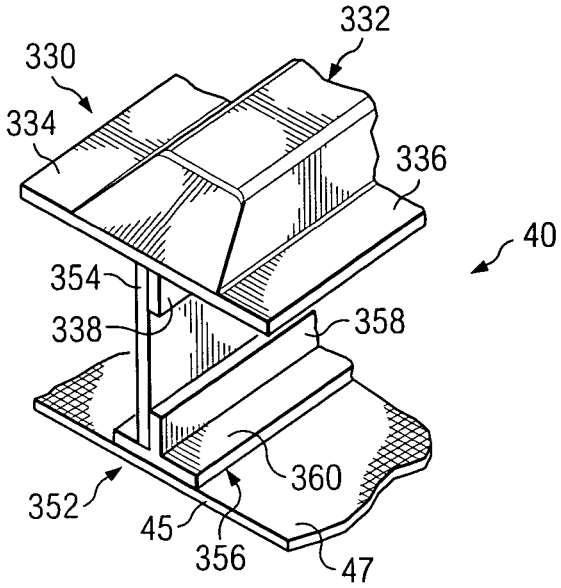
FIG. 17 is a schematic drawing showing an isometric view with portions broken away of a roof assembly incorporating teachings of the present invention.

FIG. 16 shows a portion of plenum assembly 310 which may be attached with interior portions of roof assembly 40. Various components of plenum assembly 310 may be purchased from Thermo King Corporation in Minneapolis, Minn. Examples of plenum assemblies are described in more detail in U.S. Pat. No. 6,508,076 entitled "Duct System For Temperature Controlled Cargo Containers."

Plenum assembly 310 may include a plurality of plenum panels 318 having generally rectangular configurations. Plenum panels 318 may be formed from a variety of FRP materials and/or other lightweight materials. For some applications, plenum panels 318 may be formed from Bulitex® materials similar to materials used to form layers 45, 61 and 128.

Plenum panels 318 preferably have respective openings 324 formed therein and extending therethrough. Openings 324 control airflow from plenum assembly 310 to the interior of composite box structure 30. The number of openings 324 and the pattern of openings 324 formed in each plenum panel 318 may be varied depending upon desired airflow characteristics and/or the type of lading which will be carried within railway car 20.

Chute assembly 312, attached to first end 311 of plenum assembly 310, provides an airflow path from temperature control unit 142 to plenum assembly 310. Chute assembly 312 preferably includes one or more supports 314 which may be disposed on and attached to interior bulkhead 280 adjacent to temperature control unit 142. Transition panel 316 may be attached with support 314 extending at an angle from adjacent portions of interior bulkhead 280 to plenum assembly 310. First side panel 321 and second side panel 322 may be attached to respective edges of transition panel 316 to further direct airflow from temperature control unit 142 to plenum assembly 310. Support 314, transition panel 316 and side panels 321 and 322 may be formed from aluminum or other satisfactory lightweight materials. Chute assembly 312 may be described as an outlet chute with respect to temperature control unit 142 or as an inlet chute with respect to plenum assembly 310.

The second end of plenum assembly 310 may be coupled with airflow paths formed between interior bulkhead 380 and end wall assembly 122. As a result, airflow may be provided from the second end of plenum assembly 310 into spaces formed between primary floor assembly 100 and secondary floor assembly 110.

Longitudinal connectors 342 and 344 are preferably disposed along opposite sides of plenum assembly 310 extending from first end 311 to a second end (not expressly shown) adjacent end wall assembly 122. Connectors 342 and 344 may be attached to or bonded with respective reinforcing strips 350 and adjacent portions of roof assembly 40. See FIGS. 3 and 15. A plurality of openings 346 may be formed in each longitudinal connector 342 and 344 to allow limited airflow from plenum assembly 310 outwardly towards adjacent side wall assemblies 50 and 52. The number, size and location of openings 346 may be varied to provide desired airflow from plenum assembly 310 to flow paths 63 formed by corrugations associated with respective sidewall assemblies 50 and 52.

For some applications each plenum panel 318 may include respective spacer or hanger 390 disposed approximately midway between associated connectors 342 and 344. Hangers 390 may include opening or holes 392 for use in attaching hangers 392 with reinforcing strip 350 extending generally along the longitudinal centerline of roof assembly 40. See FIG. 3.

Figure 18:
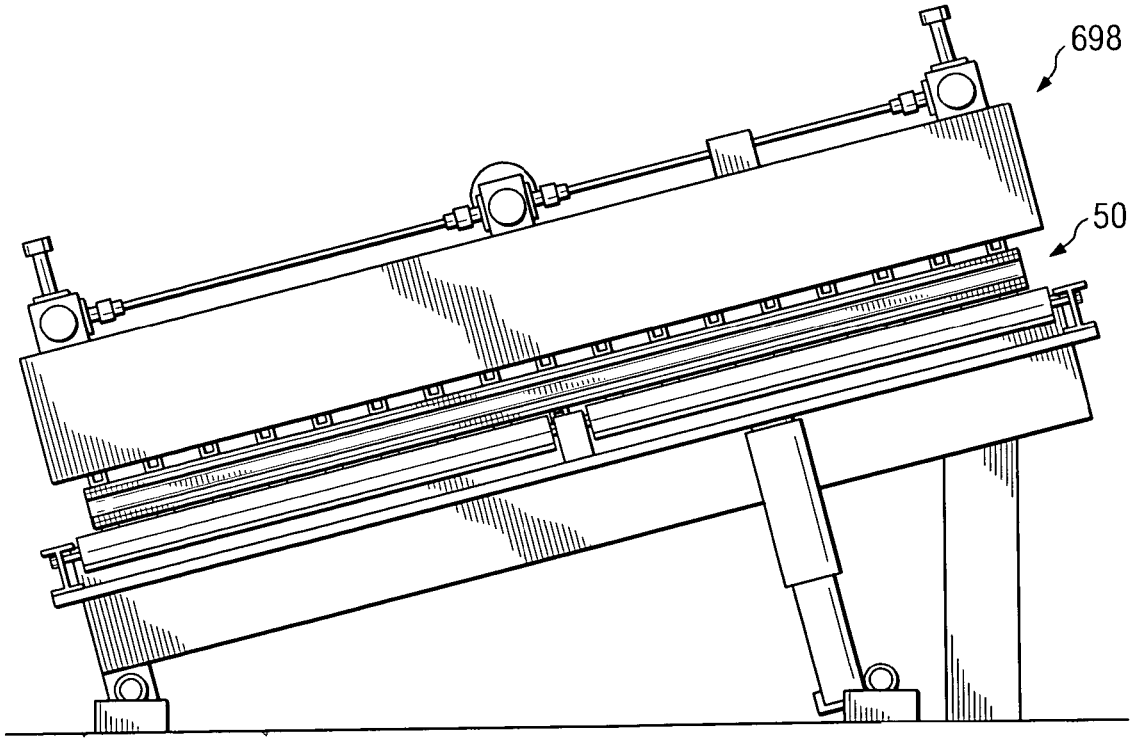
FIG. 18 is a schematic drawing showing one example of a foam press which may be satisfactorily used to bond insulating material with portions of a sidewall assembly or an endwall assembly in accordance with teachings of the present invention.

FIG. 18 shows one example of a foam press satisfactory for use in forming a sidewall assembly or an endwall assembly in accordance with teachings of the present invention. As shown in FIG. 13, foam press 698 may be tilted at an angle of approximately ten (10) degrees. For other applications the angle may be varied between eight (8) degrees and twelve (12) degrees. A foam press satisfactory for use in forming endwall assemblies and sidewall assemblies in accordance with teachings of the present invention may be obtained from CON-TEK, Inc. located at 3575 Hoffman Road East, St. Paul, Minn.

For some applications sidewall assemblies 50 and 52 and endwall assemblies 120 and 122 may be disposed at an angle between approximately eight (8) degrees and twelve (12) degrees in a foam press to allow the desired formation of insulating material 58 and associated adhesive bonds. For some applications sidewall assemblies 50 and 52 and endwall assemblies 120 and 122 may be disposed at an angle of approximately ten (10) degrees during injection of liquid insulating foam and the formation of solid foam insulation 58. The angle may be varied depending upon the configuration of the respective sidewall assembly or endwall assembly and the type of insulating foam.

Figure 19:
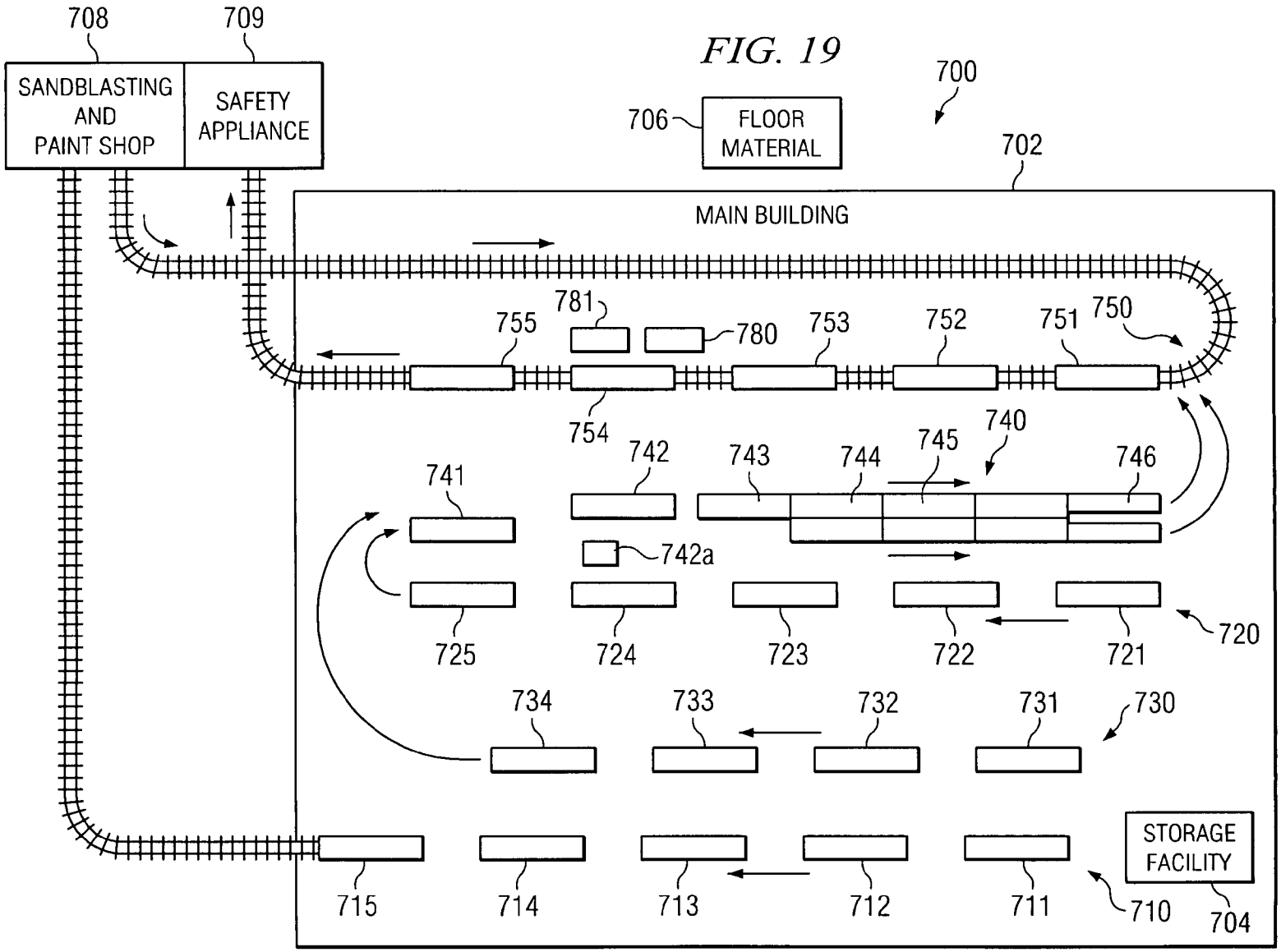
FIG. 19 is a schematic drawing showing a plan view of one example of a manufacturing facility which may be satisfactorily used to manufacture and assemble railway cars in accordance with teachings of the present invention.

One example of a manufacturing facility satisfactory in use in forming a temperature controlled railway car and/or an insulated boxcar in accordance with teachings of the present invention is shown in FIG. 19. Manufacturing facility 700 may include main building 702 and various support facilities such as storage facility 704, floor material storage facility 706, sand blasting and paint shop 708, and safety appliance shop 709. Various components associated with manufacture and/or assembly of a railway car underframe, sidewall assemblies, endwall assemblies and/or door assemblies may be available at storage facility 204 based on the type of railway car currently being produced at manufacturing facility 700.

For embodiments of the present invention as shown in FIG. 19, main building 702 may include assembly line 710 associated with forming railway car underframes, assembly line 720 associated with forming portions of a sidewall assembly, assembly line 730 associated with forming portions of an endwall assembly, assembly line 740 associated with completing manufacture of sidewall assemblies and endwall assemblies and assembly line 750 for mounting sidewall assemblies, endwall assemblies, a floor assembly and a roof assembly on an associated railway car underframe. Each assembly line 710, 720, 730, 740, and 750 may include multiple work stations. For some applications components required for manufacture and assembly of railway car underframe 200 may be stored within component storage facility 704 and taken to various work stations on assembly lines 710, 720, 730, 740 and 750 as needed.

One or more of the assembly lines shown within building 702 may be located at a remote facility. For example, endwall assemblies 120 and 122 formed in accordance with teachings of the present invention may be manufactured at a remote facility (not expressly shown) and shipped to another facility which includes assembly line 750 for mounting the endwall assemblies on a railway car underframe. All or portions of a railway car underframe may also be manufactured at a remote facility, (not expressly shown) and shipped to another facility which includes assembly line 750 for mounting various components of a composite box structure thereon. Sand blasting and paint shop 708 and/or safety appliance shop 709 may be remotely located from each other and/or main building 702.

Assembly line 710 may include work stations 711-715. Components may be moved from storage facility 704 to first station 711 to assemble center sill 214. At second station 712, additional components such as body bolsters 224 and 226 may be attached with center sill 214.

At third station 713, center sill 214 may be prepared for later attachment of associated draft gears, cushioning units and railway car couplers. At third station 713, additional components such as cross bearers 217, cross ties 216 and end sill assemblies 220 and 222, may also be attached with center sill 214. At fourth station 714, additional components (not expressly shown) may also be attached to railway car underframe 200.

At fifth station 715, railway trucks may be attached with each railway car underframe. The railway car underframe may then be directed to sand blasting and paint shop 708. For some applications temporary railway trucks may be used to move each railway car underframe to sand blasting and paint shop 708. After sand blasting and/or painting of each railway car underframe 200 has been completed, railway trucks 202 and 204 may be attached thereto. The resulting railway car underframe 200 may then be directed to assembly line 750 for assembly of composite box structure 30 thereon.

Railway car underframe 200 may also be manufactured and assembled at a remote facility and shipped to manufacturing facility 700. Railway car underframe 200 may be substantially ready for attachment with railway trucks 202 and 204 when received at manufacturing facility 700. For some applications railway car underframe 200 may be initially sent to sand blasting and paint shop 708 followed by mounting on railway car trucks 202 and 204. From sand blasting and paint shop 708 railway car underframe 200 disposed on railway trucks 202 and 204 may be moved to assembly line 750. Side sill assemblies 250 and 252 may be removed from railcar underframe 200 at station 751 and taken to assembly line 730 for use in manufacture of respective sidewall assemblies 50 and 52. When railway car underframe 200 is initially manufactured and assembled at manufacturing facility 700, side sill assemblies 250 and 252 may be taken to assembly line 730 as appropriate.

Various components may be taken from storage facility 704 and moved to assembly line 730 for use in manufacturing sidewall assemblies 50 and 52. At first station 731 side sill assembly 250 or 252 and associated top plate or top chord 64 may be prepared. At second station 732 respective support posts 56 may be attached with top chord 64 and associated side sill assembly 250 or 252 to form a sidewall frame assembly (not expressly shown). Door frame assembly 190 may also be installed as part of the sidewall frame assembly at second station 732.

At third station 733, a plurality of metal sheets 54 may be welded with exterior portions of top chord 64, support posts 56 and associated side sill assembly 250 or 252. Exterior welds may generally be formed at third station 733 between each sidewall frame assembly and associated metal sheets 54. At fourth station 734, interior welds may be formed between each sidewall frame assembly and associated metal sheets 54. Each sidewall frame assembly and attached metal sheets 54 may then be moved to first station 741 of assembly line 740.

Various components may be taken from storage facility 704 and moved to assembly line 720 for use in manufacturing endwall assemblies 120 and 122. At first station 721 top plates (not expressly shown), end beams 126, bottom plates 124 and end plates (not expressly shown) may be prepared for use in forming endwall assemblies in accordance with teachings of the present invention. At second station 722, each endwall frame assembly (not expressly shown) associated with endwall assemblies 120 may be formed from respective end beams 126, top plate, end plates and bottom plate 124. At second station 722 portions of opening 127 may be formed in the endwall frame assembly for later installing temperature control unit 142.

At third station 723 each endwall frame assembly associated with endwall assemblies 122 may be formed from respective end beams 126, top plate, end plates and bottom plate 124. At fourth station 724 metal sheets 54 may be placed on the exterior of each endwall frame assembly and welded with adjacent portions thereof. At fourth station 724 exterior welds may be formed between associated metal sheets and each endwall frame assembly. At fifth station 725 interior welds may be formed between each endwall frame assembly and associated metal sheets. Each endwall frame assembly with attached metal sheets 54 may then be moved to first station 741 of assembly line 740.

Sidewall assemblies 50 and 52 and endwall assemblies 120 and 122 may be directed from respective assembly lines 730 and 720 to assembly line 740. At first station 741, each sidewall assembly and endwall assembly may be washed and cleaned in preparation for injecting liquid insulating foam. Various phosphate coating or other coating techniques may be used at station 741. Sidewall assemblies may be dried at station 742. Endwall assemblies may be dried at station 742*a*.

Isolators 60 and portions of associated scuff plate support assemblies 230 and 240 may be bonded with associated support posts 56 and layers 61 of fiber reinforced material may be disposed thereon on each sidewall assembly 50 and 52 at third station 743. Isolators 60 may be disposed on respective first surface 125 of end beams 126 of endwall assemblies 120 and 122 at third station 743. Layers 128 of fiber reinforced material may be disposed on isolators 60. Sidewall assemblies 50 and 52 may then be preheated at fourth stations 744. Endwall assemblies 120 and 122 may also be preheated at fourth station 744.

At least one foam press, such as foam press 698 shown in FIG. 18, may be provided at fifth station 745. Liquid insulating foam may be injected into respective void spaces in sidewall assemblies 50 and 52 and endwall assemblies 120 and 122. Foam press 698 provides required temperature control to form foam insulation 58 with bonds between interior surface of side sheets 54, adjacent portions of support post 56 or end beams 126, and interior portions of layers 61 or 128. Slats (not expressly shown) may be placed in corrugations 63 to protect corrugations 63 during foaming and pressing associated with forming insulating material 58.

At fifth station 745, sidewall assemblies 50 and 52 and endwall assemblies 120 and 122 are allowed to cool to complete the foam insulation process. At sixth station 746, final preparation of sidewall assemblies 50 and 52 and endwall assemblies 120 and 122 for mounting on associated railway car underfoam 200 may be completed.

Sidewall assemblies 50 and 52 and endwall assemblies 120 and 122 may then be directed to assembly line 750. At first station 751, sidewall assemblies 50 and 52 may be attached with railway car underframe 200. At second station 752, primary floor 100 may be mounted on and attached with selected portions of railway car underframe 200. At second station 752 any additional weld-out which may be required with respect to sidewall assemblies 50 and 52, endwall assemblies 120 and 122 and railway car underframe 200 may be completed. At third station 753 primary floor 100 may be mounted on and attached with selected portions of railway car underframe 200.

One or more roof assemblies 40 may be stored at work station 780. At work station 780 each roof assembly 40 may be prepared for mounting on a composite box structure in accordance with teachings of the present invention. At fourth station 745 roof assembly 40 may be attached with sidewall assemblies 50 and 52 and endwall assemblies 120 and 122 opposite from primary floor 100.

At work station 781 door assemblies 180 may be prepared by attaching operating pipes, locking bars, gears, rollers and other hardware associated with slidably mounting door assemblies on railway cars. Door assemblies 180 may be mounted on tracks 194 and 196 associated with each opening 36 at fifth station 755. At stations 753, 754 and/or 755 various flexible connections and/or corner joints may be foamed with insulation and trim molding applied thereto.

From fifth station 755, the resulting railway car may be directed to safety appliance shop 709 for attachment of brakes and other equipment and sand blasting and paint shop 708 to complete manufacture and assembly of railway car 20.

FIGS. 20-23 are block diagrams which show various steps associated with forming a temperature controlled railway car or an insulated boxcar in accordance with teachings of the present invention. The sequence of steps shown in FIG. 20—method 500, FIG. 21—method 560, FIG. 22—method 570, or FIG. 23—method 590 may be varied as desired for a specific manufacturing facility or railway car design.

For some applications, all of the steps associated with method 500 may be carried out at the same manufacturing facility. For other applications, one or more of the steps associated with method 500 may be carried out at one or more remotely located facilities. One of the benefits of the present invention includes optimizing the manufacture and assembly of components associated with a composite box structure.

Figure 20:
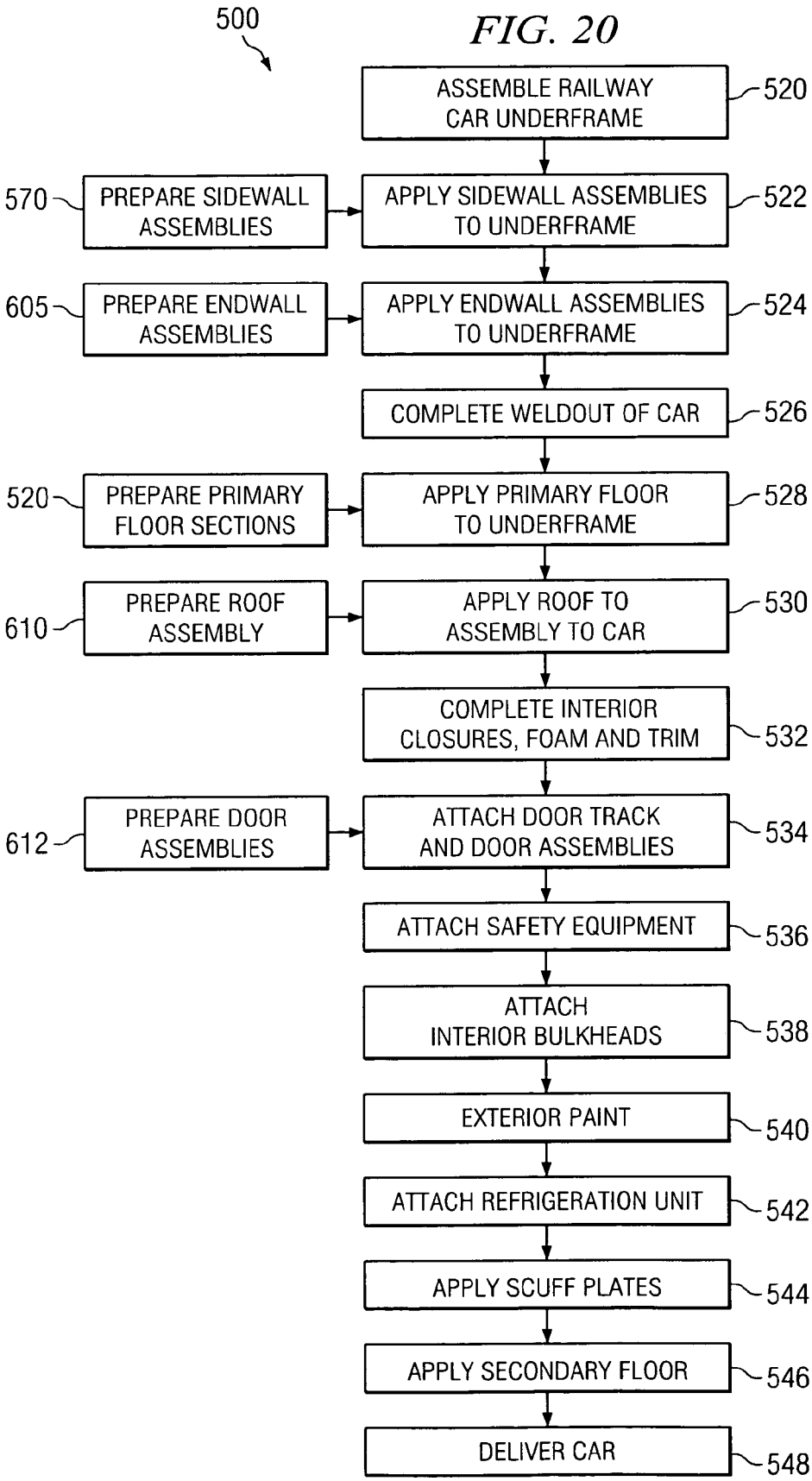
FIG. 20 is a block diagram showing one example of a method for assembling a temperature controlled railway car in accordance with teachings of the present invention.

In FIG. 20 method 500 for forming a temperature controlled railway car such as previously described railway car 20 starts with the assembly of railway car underframe 200 at step 520. Other steps associated with assembling railway car underframe 200 will be discussed with respect to method 560 of FIG. 21.

Figure 22:
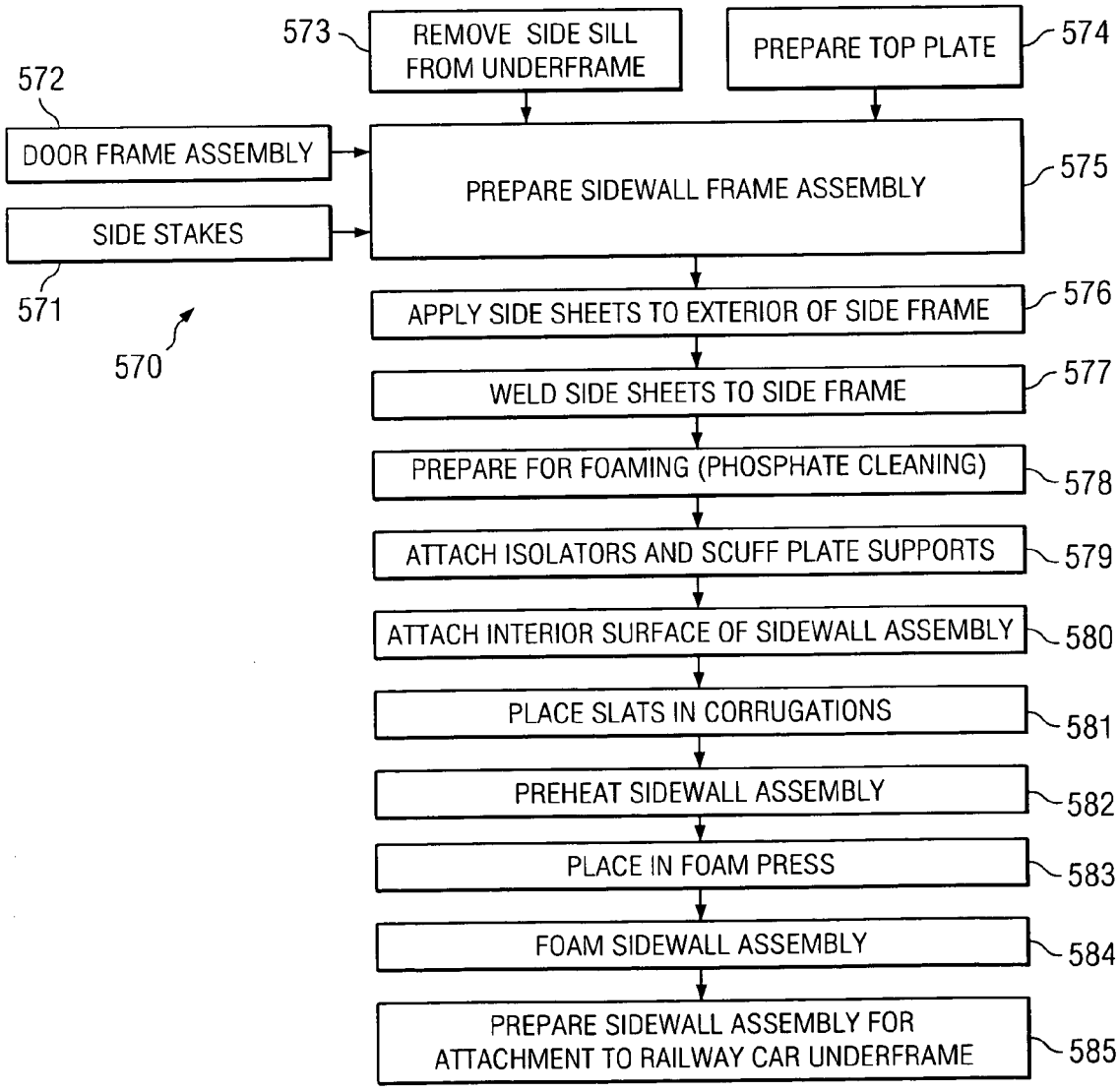
FIG. 22 is a block diagram showing one example of a method for manufacture and assembly of a sidewall assembly in accordance with teachings of the present invention.

Sidewall assemblies 50 and 52 may be prepared at step 570. Additional steps associated with preparation of sidewall assemblies 50 and 52 are shown in FIG. 22. At step 522 sidewall assemblies 50 and 52 may be attached with opposite sides of railway car underframe 200.

Figure 23:
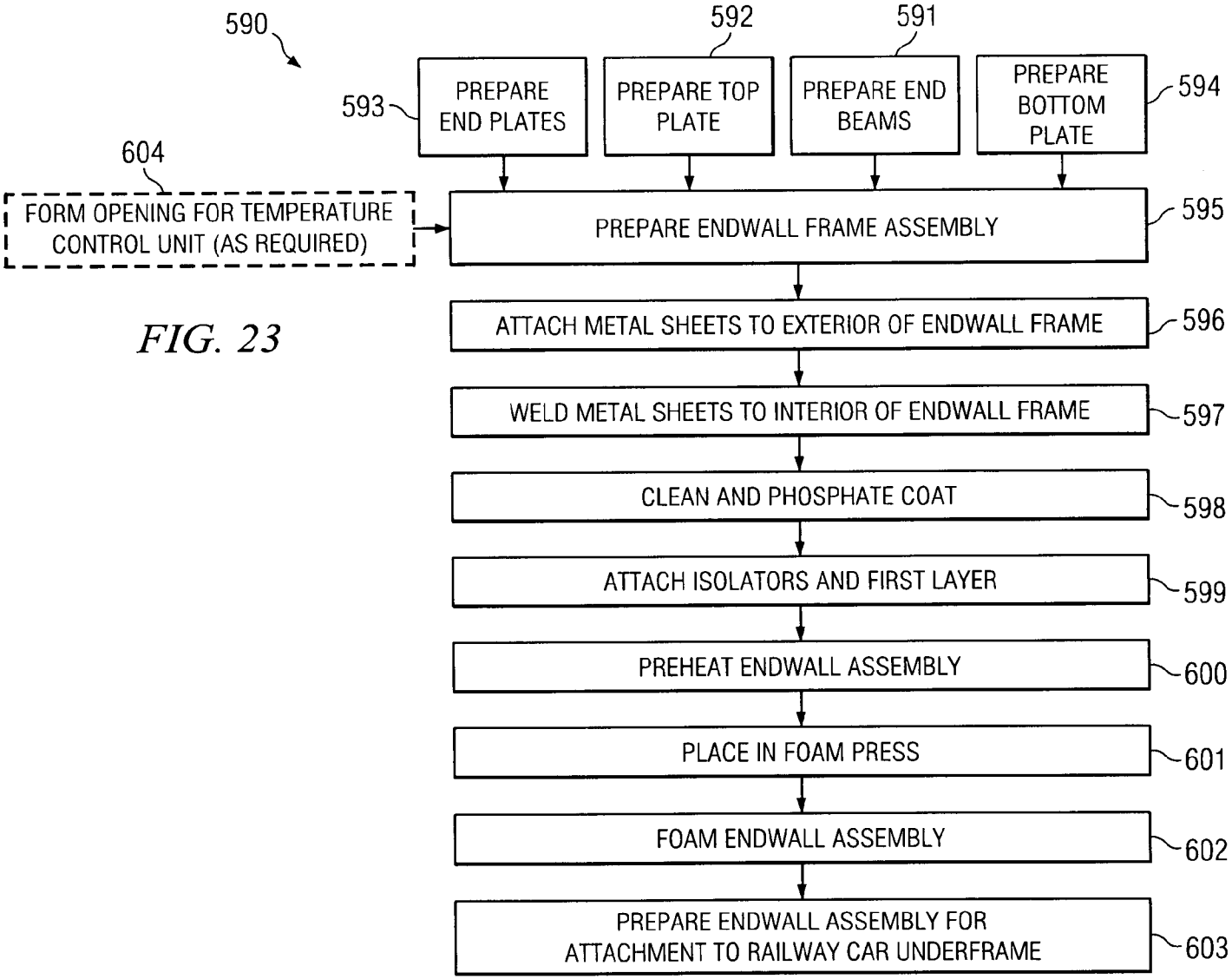
FIG. 23 is a block diagram showing one example of a method for manufacture and assembly of an endwall assembly in accordance with teachings of the present invention.

Endwall assemblies 120 and 122 may be prepared at step 605. Additional steps associated with manufacturer and assembly of endwall assemblies 120 and 122 are shown in FIG. 23. At steps 524 endwall assemblies 120 and 122 may be attached to opposite ends of railway car underframe 200. Any remaining weld out required for railway car underframe 200 and/or attachment of sidewall assemblies 50 and 52 with endwall assemblies 120 and 122 may be completed at step 526.

Various components associated with primary floor assembly 100 may be prepared at step 520. At step 528, components associated with primary floor 100 may be applied to and bonded with portions of railway car underframe 200.

Roof assembly 40 may be prepared at step 610. At step 530 roof assembly 40 may be attached with sidewall assemblies 50 and 52 and endwall assemblies 120 and 122 opposite from primary floor assembly 100 and railway car underframe 200. For some applications roof assembly 40 may be attached with sidewall assemblies 50 and 52 and endwall assemblies 120 and 122 prior to attaching primary floor assembly 100 with railway car underframe 200.

At step 532 interior portions of composite box structure 30 may be completed. Flexible joints and corner joints formed between adjacent portions of sidewall assemblies 50, 52, endwall assemblies 120, 122, roof assembly 40 and floor assembly 80 may be filled with insulating foam and covered with trim molding at step 532. For some applications blocks of urethane foam or other suitable insulating materials may be installed in the joints. Insulating foam may then be injected into the joints to complete filling each joint with insulating material. For other applications one or more joints may be filled with only insulating foam to provide desired insulating material. Insulating foam such as liquid foam or froth foam may be obtained from several vendors including Foam Supply Industries (FSI) and Carpenter Foam Co.

For some applications, as shown in FIG. 3, one or more rows of sealant 248 may be disposed between the edges of primary floor assembly 100 and adjacent portions of sidewall assemblies 50 and 52. Respective trim molding 370 may then be attached on and bonded with adjacent portions of sidewall assemblies 50 and 52 and primary floor assembly 100. Similar trim molding 370 may be attached with adjacent portions of roof assembly 40 and endwall assemblies 120 and 122.

At step 612 door assemblies 180 may be prepared. Respective door assemblies 180 may then be slidably mounted on tracks 194 and 196 adjacent to opening 36 in each sidewall assembly 50 and 52 at step 534. After door assemblies 180 have been attached, associated railway car 20 may be moved to safety appliance shop 709.

At step 536 safety equipment may be attached with railway car underframe 200 and/or composite box structure 30. Examples of such safety equipment include hand brakes, ladders, etc. At step 538, interior bulkheads 280 and 380 may be attached with respective endwall assemblies 120 and 122. After bulkheads 280 and 380 have been attached, the associated railway car 200 may be moved to sand blasting and paint shop 708.

At step 540, the exterior of composite box structure 30 may be painted. Upon completion of painting, railway car 20 may be moved to safety appliance shop 780 for the attachment of refrigeration unit 142 and scuff plates 241 and 242 at step 524.

Secondary floor assembly 110 may be installed on primary floor assembly 100 at step 546. Final inspection of temperature controlled railway car 120 and correction of any further assembly procedures may also be completed at step 546. Railway car 20 may then be delivered to a customer at step 548.

Figure 21:
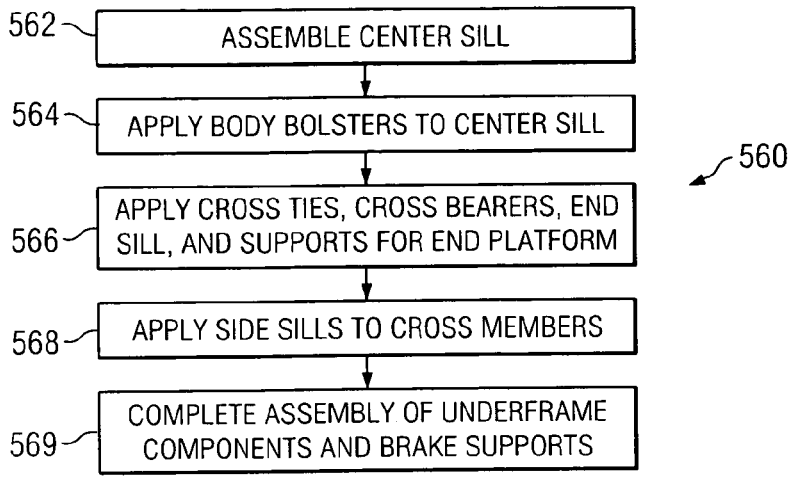
FIG. 21 is a block diagram showing one example of a method for assembling a railway car underframe.

Assembly of railway car underframe 200 may include various steps. Method 560 as shown in FIG. 21 is only one example. Center sill 214 may be assembled at step 562. Respective body bolsters may be attached with center sill 214 at step 564. At step 566 a plurality of cross bearers 217 and cross ties 216 may be attached on both sides of center sill 214. End sills 216 and 222 may be attached to opposite ends of center sill 214. Supports for end platform 260 may also be mounted on railway car underframe 200. At step 568 side sill assemblies 250 and 252 may be attached to respective cross members. At step 569 assembly of other components such as brake supports associated with railway car underframe 200 may be completed. Railway car underframe 200 (without railway car trucks 202 and 204) may be shipped to another facility to another manufacturing facility associated with assembly of railway car 20.

For purposes of describing various features of the present invention, sidewall assemblies 50 and 52 will be described with respect to forming an associated sidewall frame assembly. Each sidewall frame assembly may include a plurality of support posts 56, respective side sill assemblies 250, 252 and respective top chords 64. Each sidewall frame assembly also includes portions of associated door frame assembly 190. Examples of sidewall frame assemblies are shown in U.S. patent application Ser. No. 10/071,513 filed Feb. 8, 2002 entitled Manufacturing Facility and Method of Assembling Temperature Controlled Railcar, now U.S. Pat. No. 6,892,433.

After assembly of each sidewall frame assembly along with associated isolators 60*a*, 60*b* and 60*c* and layers 61 of fiber reinforced plastic, a plurality of injection blocks (not expressly shown) may be disposed between portions of each top chord 64 and adjacent portions of support posts 56. A plurality of openings may be formed within each injection block to allow injecting liquid insulating foam into the associated void spaces defined in part by interior surface 55 of metal sheet 54, adjacent portions of support posts 56 and the interior surface of first layers 61.

The injection blocks may be formed from substantially the same material as the liquid insulating foam which will be injected into sidewall assemblies 50 and 52. After the liquid insulating foam is solidified, the injection blocks form an integral component of the associated foam insulation 58. Injection blocks or foam dams may be attained from various suppliers such as R.Max located in Dallas, Tex. Liquid insulating foam, sometime referred to as pour foam, may be obtained from various vendors including Carpenter Foam Co. and Foam Supply, Inc. (FSI).

As shown in FIG. 22, fabricating a sidewall assembly may include various steps such as preparing support posts or side stakes at step 571, preparing a door frame assembly at step 572, removing a side sill assembly from a railway car underframe at step 573 and preparing a top plate at step 574. A sidewall frame assembly may be prepared at step 575 by attaching support posts 56 with top plate 64 and side sill assembly 250 as previously described. Associated door frame assembly 190 may also be attached with top chord 64 and side sill assembly 250 at the desired location for opening 36.

At step 576, a plurality of metal sheets or side sheets 54 may be placed on the exterior of the sidewall frame assembly. At step 577 metal sheets 54 may be welded with the adjacent portions of the sidewall frame assembly. At step 578 the sidewall frame assembly may be cleaned. At step 579 isolators and scuff plate supports may be placed on interior surfaces 57 of support posts 56. Layers 61 of fiber reinforced material may also be placed on isolators 60 at step 580. At step 581 slats may be placed in corrugations 63. At step 582 the sidewall assembly may be preheated. At step 583 the sidewall assembly may be placed in a foam press such as shown in FIG. 18. At step 584 liquid insulating foam may be injected into void spaces formed between metal sheets 54, adjacent portions of support posts 56 and the interior surface of the layers 61. At step 585 sidewall assemblies 50 and 52 may be prepared for attachment to railway car underframe 200.

For purposes of describing various features of the present invention, endwall assemblies 120 and 122 may be described with respect to forming an associated endwall frame assembly. Each endwall frame assembly may include a respective top plate or top chord (not expressly shown), bottom plate 124 and edge plates (not expressly shown) attached thereto and extending therebetween. The top plate, bottom plate 124 and edge plates form a generally rectangular pattern corresponding with associated endwall assembly 120 and 122. Examples of endwall frame assemblies are shown in U.S. patent application Ser. No. 10/071,513 filed Feb. 8, 2002 entitled Manufacturing Facility and Method of Assembling Temperature Controlled Railcar, now U.S. Pat. No. 6,892,433.

For some applications a plurality of openings (not expressly shown) may be formed in one or more edge plates. The openings may be used to inject liquid insulating foam into respective void spaces when each endwall frame assembly with isolators 60 and layer 128 have been placed into a foam press. The number and size of the openings formed in the edge plates will depend upon the configuration and size of associated void spaces formed adjacent to end beams 126.

As shown in FIG. 23, fabrication of an endwall assembly may include various steps such as preparing end beams 126 at step 591. A top plate may be prepared at step 592. End plates may be prepared at step 593. Bottom plate 124 may be prepared at step 594. At step 595 end beams 126 may be attached with a first edge plate and a second edge plate to form a generally rectangular configuration. The top plate may be attached adjacent to one end of each edge plate. Bottom plate 124 may be attached with opposite ends of the edge plates to form an endwall frame assembly.

For each endwall assembly 120, step 604 may also be carried out, which includes forming a frame for opening 127 to accommodate an associated temperature control unit. At step 596 metal sheets 54 may be attached with the exterior of the endwall frame assembly. At step 597 metal sheets 54 may be welded with the interior of the end frame assembly. At step 598 the end frame assembly and attached metal sheets may be cleaned and phosphated.

At step 599 isolators 60 may be attached with the interior surface of end beams 126. Layers 128 of fiber reinforced material may also be placed on isolators 60. At step 600 the endwall assembly is preheated. At step 601 the endwall assembly may be placed in a foam press. Liquid insulating foam may be injected through openings (not expressly shown) in the edge plates at step 602. The foam press preferably provides sufficient heat to form solid foam insulation from the liquid insulating foam. At step 603 the endwall assembly may be removed from the foam press, cooled and prepared for attachment with the associated railway car underframe.

Although the present invention and its advantages have been described in detail, it should be understood that various changes, substitutions and alternations can be made herein without departing from the spirit and scope of the invention as defined by the following claims.

What is claimed is:

1. A method for assembling a railway car comprising:

forming a railway car underframe defined in part by a center sill having a plurality of cross ties, cross bearers and body bolsters extending therefrom along with a first end sill and a second end sill disposed adjacent to opposite ends of the center sill;

forming a pair of sidewall assemblies and a pair of endwall assemblies with each sidewall assembly and each endwall assembly having an exterior metal surface and an interior surface of fiber reinforced material with foam insulation disposed therebetween;

forming each sidewall assembly with an opening for loading and unloading lading;

attaching a first sidewall assembly with one side of the railway car underframe;

attaching a second sidewall assembly with the other side of the railway car underframe;

attaching a first endwall assembly with the first end sill of the railway car underframe;

attaching a second endwall assembly with the second end sill of the railway car underframe;

attaching a roof assembly to the sidewall assemblies and the endwall assemblies opposite from the railway car underframe;

attaching a primary floor assembly to the railway car underframe;

applying insulating material to respective joints formed between the endwall assemblies and the sidewall assemblies, the primary floor assembly and the sidewall assemblies and the endwall assemblies, and the roof assembly and the endwall assemblies and the side assemblies;

attaching a door assembly adjacent to the respective opening formed in each sidewall assembly to control access to the railway car; and installing a secondary floor assembly on the primary floor opposite from the railway car underframe.

2. The method of claim 1 wherein forming each sidewall assembly further comprises:

removing a respective side sill assembly from the railway car underframe; and attaching a plurality of support posts, metal sheets and a top chord to the respective side sill assembly to form a generally smooth, exterior metal surface for each sidewall assembly.

3. The method of claim 1 wherein forming each endwall assembly further comprises:

forming a plurality of end beams for each endwall assembly;

forming a respective bottom plate for each endwall assembly; and attaching a plurality of metal sheets with the end beams and the bottom plate to form a generally smooth, exterior metal surface for each endwall assembly.

4. The method of claim 1 further comprising:

removing each side sill assembly from the railway car underframe;

attaching a plurality of support posts with each side sill assembly and a respective top chord for each sidewall assembly;

attaching a plurality of metal sheets with the respective top chord, support posts and side sill assembly to form an exterior metal surface for each sidewall assembly;

attaching layers of fiber reinforced material with the support posts opposite from the metal sheets to form an interior surface for each sidewall assembly;

injecting liquid insulating foam into void spaces formed between the metal sheets, the support posts and the layers of fiber reinforced material associated with each sidewall assembly;

applying heat to the liquid insulating foam to form solid foam insulation disposed between adjacent portions of the metal sheets, support posts and layers of fiber reinforced material; and pressing the layers of fiber reinforced material and liquid insulating foam while applying the heat to maintain desired dimensions for each sidewall assembly during formation of the solid foam insulation.

5. The method of claim 4 after comprising placing a plurality of isolators on the support posts opposite from the attached metal sheets prior to attaching the layers of fiber reinforced material with the support posts.

6. The method of claim 4 further comprising:

attaching a first isolator to each support post;

attaching a second isolator to each support post spaced from the first isolator; and attaching a first scuff plate support assembly to each support post between the first isolator and the second isolator before the layers of fiber reinforced material are attached to the support posts.

7. The method of claim 6 further comprising attaching a first scuff plate with the first scuff plate support assemblies after the respective sidewall assembly has been attached to the railway car underframe.

8. The method of claim 6 further comprising:

attaching a third isolator to each support post spaced from the second isolator; and attaching a second scuff plate support assembly to each support post between the second isolator and the third isolator before the layers of fiber reinforced fabric are attached to the support posts.

9. The method of claim 8 further comprising attaching a second scuff plate with the second scuff plate support assemblies after the respective sidewall assembly has been attached to the railway car underframe.

10. The method of claim 1 further comprising forming at least one expansion joint in the primary floor assembly.

11. A method for forming an insulated railway car comprising:

forming a railway car underframe having a generally elongated, rectangular perimeter defined in part by a first end sill and a second end sill and a first side sill assembly and a second side sill assembly spaced from each other and extending longitudinally between the first end sill and the second end sill;

removing the side sill assemblies from the railway car underframe;

forming a pair of sidewall assemblies and a pair of endwall assemblies with each endwall assembly and each sidewall assembly respectively formed from a plurality of metal sheets having respective exterior surfaces and interior surfaces;

attaching a plurality of support posts spaced from each other with the interior surfaces of the metal sheets associated with each sidewall assembly extending between the respective side sill assembly and a respective top chord;

attaching a plurality of end beams spaced from each other with the interior surfaces of the metal sheets associated with each endwall assembly;

attaching respective isolators to each support post and each end beam opposite from the attached metal sheets;

placing layers of fiber reinforced material with corrugation formed therein on the associated isolators to form respective interior surfaces for the sidewall assemblies;

placing layers of fiber reinforced material on the associated isolators to form respective interior surfaces for the endwall assemblies;

respectively placing each sidewall assembly and each endwall assembly in a mold press and injecting insulating material into void spaces formed between the metal sheets, support posts, end beams and layers of fiber reinforced material to form foam insulation bonded with interior surfaces of the metal sheets, adjacent support posts, adjacent end beams and adjacent portions of the fiber reinforced material associated with each sidewall assembly and each endwall assembly;

coupling the side sill assembly of each sidewall assembly with the railway car underframe; and coupling each endwall assembly with the railway car underframe.

12. The method of claim 11 further comprising placing a respective slat in each corrugation of the sidewall assemblies prior to placing the sidewall assemblies in the mold press.

13. The method of claim 11 further comprising applying pressure and heat to the insulating material to form foam insulation bonded with the metal sheets.

14. The method of claim 11 further comprising:

attaching each side sill assembly with one end of the associated support posts and one edge of the associated metal sheets;

attaching a top chord with an opposite edge of the associated metal sheets and an opposite end of the associated support posts;

inserting a respective injection block having a plurality of holes extending therethrough into selected void spaces adjacent to each top chord; and injecting the insulating material into the associated void spaces through the holes in the associated injection block.

15. The method of claim 14 further comprising injecting liquid urethane into the void spaces to form the foam insulation.

16. A method of forming a railway car comprising:

forming a railway car underframe with a center sill and a plurality of cross members extending laterally therefrom and spaced respectively from a first end sill and a second end sill;

forming a pair of sidewall assemblies with each sidewall assembly having a respective side sill assembly formed as an integral component thereof and a respective opening for loading and unloading lading;

forming a pair of endwall assemblies with each endwall assembly having a respective bottom plate formed as an integral component thereof attaching one of the sidewall assemblies with the railway car underframe by forming a plurality of mechanical couplings between the respective side sill assembly and respective ends of the cross members;

attaching the other sidewall assembly with the railway car underframe by forming a plurality of mechanical couplings between the respective side sill assembly and respective ends of the cross members;

attaching the bottom plate of one of the endwall assemblies with one end sill of the railway car underframe; and attaching the bottom plate of the other endwall assembly with the other end sill of the railway car underframe.

17. The method of claim 16 further comprising:

attaching a respective first scuff plate on an interior surface of each sidewall assembly with a first segment of each first scuff plate extending longitudinally from proximate the first endwall assembly to proximate an opening formed in the respective sidewall assembly; and attaching a respective second segment of each first scuff plate with the interior surface of each sidewall assembly with each second segment of the respective first scuff plate extending longitudinally from proximate the opening formed in each sidewall assembly to proximate the second endwall assembly.

18. The method of claim 17 further comprising:

attaching a respective second scuff plate on the interior surface of each sidewall assembly with a first segment of each second scuff plate extending longitudinally from proximate the first endwall assembly to proximate the opening formed in the respective sidewall assembly; and attaching a respective second segment of each second scuff plate with the interior surface of each sidewall assembly with each second segment of the respective second scuff plate extending longitudinally from proximate the respective opening formed in each sidewall assembly to proximate the second endwall assembly.

* * * * *